US012595105B2

(12) United States Patent
Miyatani et al.

(10) Patent No.: US 12,595,105 B2
(45) Date of Patent: Apr. 7, 2026

(54) BEVERAGE CONTAINER, AND A METHOD OF ASSEMBLING A BEVERAGE CONTAINER

(71) Applicants: Asahi Group Holdings, Ltd., Tokyo (JP); Asahi Breweries, Ltd., Tokyo (JP)

(72) Inventors: Tomohisa Miyatani, Ibaraki (JP); Masanori Yamagishi, Tokyo (JP); Motohiro Inagaki, Tokyo (JP)

(73) Assignees: Asahi Group Holdings, Ltd., Tokyo (JP); Asahi Breweries, Ltd., Tokyo (JP)

( * ) Notice: Subject to any disclaimer, the term of this patent is extended or adjusted under 35 U.S.C. 154(b) by 127 days.

(21) Appl. No.: 18/689,607

(22) PCT Filed: Jul. 12, 2022

(86) PCT No.: PCT/JP2022/027407
§ 371 (c)(1),
(2) Date: Mar. 6, 2024

(87) PCT Pub. No.: WO2023/095380
PCT Pub. Date: Jun. 1, 2023

(65) Prior Publication Data

US 2024/0375843 A1 Nov. 14, 2024

(30) Foreign Application Priority Data

Nov. 25, 2021 (JP) ..... 2021-191542

(51) Int. Cl.
*B65D 77/06* (2006.01)
*B65D 85/72* (2006.01)

(52) U.S. Cl.
CPC ..... *B65D 77/06* (2013.01); *B65D 85/72* (2013.01)

(58) Field of Classification Search
CPC ..... B65D 77/06; B65D 77/065–067; B65D 83/38; B65D 83/62; B65D 85/72;
(Continued)

(56) References Cited

U.S. PATENT DOCUMENTS 3,083,875 A * 4/1963 Welty ..... B67D 1/0878 222/464.7
5,335,821 A * 8/1994 Osgar ..... B65D 85/84 222/105
(Continued)

FOREIGN PATENT DOCUMENTS

CN 106185033 12/2016
EP 318623 5/2018
(Continued)

OTHER PUBLICATIONS

Extended European Search Report issued Oct. 22, 2025 in European Patent Application No. 22898165.0.
(Continued)

*Primary Examiner* — Frederick C Nicolas
*Assistant Examiner* — Randall A Gruby
(74) *Attorney, Agent, or Firm* — WENDEROTH, LIND & PONACK, L.L.P.

(57) ABSTRACT

A beverage container includes an outer container having a first mouth portion, a fitting, and a replaceable component arranged in an inner space of the outer container. The fitting includes an attachment portion attached to the first mouth portion of the outer container, a second mouth portion, an annular portion extending outward from the second mouth portion and connecting the second mouth portion and the attachment portion, and a beverage extraction pipe extending toward a bottom of the outer container. The replaceable component includes a sealing member slidable along a longitudinal direction of the beverage extraction pipe and
(Continued)

being in annular contact with an outer surface of the beverage extraction pipe at an installation position, a tubular body holding the sealing member and being supported by the beverage extraction pipe via the sealing member located at the installation position, and a bag for containing a beverage attached to the tubular body.

10 Claims, 27 Drawing Sheets

(58) Field of Classification Search
CPC ..... B67D 2001/0824–0825; B67D 1/0832; B67D 1/0829; B67D 1/0802; B67D 1/0462
See application file for complete search history.

(56) References Cited

U.S. PATENT DOCUMENTS

| | | | | |
|---|---|---|---|---|
| 6,015,068 | A * | 1/2000 | Osgar | B67D 7/344 222/105 |
| 6,516,839 | B1 * | 2/2003 | Timp | B67D 1/0832 141/2 |
| 6,942,127 | B2 * | 9/2005 | Raats | B67D 1/0462 137/212 |
| 7,111,442 | B1 * | 9/2006 | Van Baal | B65D 77/06 53/284.7 |
| 8,052,014 | B2 * | 11/2011 | Hasegawa | B67D 7/0294 137/212 |
| 8,371,469 | B2 * | 2/2013 | Takedutsumi | B65D 77/06 220/495.05 |
| 8,381,768 | B2 * | 2/2013 | Hasegawa | B67D 7/0261 251/149.6 |
| 8,646,660 | B2 * | 2/2014 | Bates | B67D 1/0462 222/105 |
| 8,777,056 | B2 * | 7/2014 | Bates | B65D 7/045 222/105 |
| 9,045,325 | B2 * | 6/2015 | Apps | B67D 1/0808 |
| 9,714,163 | B2 * | 7/2017 | Standaert | B67D 1/0418 |
| 11,299,384 | B2 * | 4/2022 | Walton | B67D 1/0845 |
| 2010/0102087 | A1 * | 4/2010 | Meike | B67D 1/0832 222/105 |
| 2012/0037625 | A1 * | 2/2012 | Hasunuma | F16L 37/413 220/200 |
| 2012/0104035 | A1 | 5/2012 | Bates et al. | |
| 2018/0149269 | A1 * | 5/2018 | Schneider | F16J 15/106 |
| 2020/0307898 | A1 * | 10/2020 | Rhoades | B67D 1/0832 |
| 2021/0371267 | A1 * | 12/2021 | Walton | F16K 15/063 |
| 2022/0002136 | A1 * | 1/2022 | Tansley | B67D 1/0835 |
| 2023/0035704 | A1 * | 2/2023 | Gebbink | B67D 1/0462 |
| 2023/0166887 | A1 * | 6/2023 | Miyatani | B65D 25/48 222/567 |
| 2024/0367882 | A1 * | 11/2024 | Miyatani | B65D 77/06 |
| 2024/0375843 | A1 * | 11/2024 | Miyatani | B67D 1/0462 |

FOREIGN PATENT DOCUMENTS

| | | |
|---|---|---|
| GB | 1032825 | 6/1966 |
| JP | 2018-30639 | 3/2018 |
| JP | 2019-142581 | 8/2019 |
| WO | 01/00502 | 1/2001 |
| WO | 2015/156085 | 10/2015 |
| WO | 2020/198217 | 10/2020 |
| WO | 2021/241177 | 12/2021 |

OTHER PUBLICATIONS

International Search Report issued Oct. 4, 2022 in International (PCT) Application No. PCT/JP2022/027407.

* cited by examiner

BEVERAGE CONTAINER, AND A METHOD OF ASSEMBLING A BEVERAGE CONTAINER

TECHNICAL FIELD

The present invention relates to a beverage container and a method of assembling a beverage container.

BACKGROUND ART

A beverage container having a rigid outer container and a flexible inner container is known.

As a related art, Patent Literature 1 discloses a container containing a storage bag. The container described in Patent Literature 1 includes an outer container (5) having an opening (22), a storage bag (1) accommodated in the outer container (5) and having a spout (4), and a lid portion (8) connected to both the storage bag and the outer container. In Patent Literature 1, it is described that the hole portion of the spout (4) and the hole portion of the lid portion (8) are fitted, and that the spout (4) and the pouring nozzle (6) are connected.

Patent Literature 2 discloses a flexible container produced from a film material. The flexible container described in Patent Literature 2 includes a cap (5) attached to a neck of a rigid outer container (2), a fixing lip (4) forming a part of the cap (5), a bag (3) that is fixed to the fixing lip (4), a shut-off valve (10) that can be pushed downward, and a dispenser tube (8).

Patent Literature 3 discloses a beverage supply device. The beverage supply device described in Patent Literature 3 includes a container body (20) including a neck part (22), a flexible bag body (90) arranged inside the container body (20), a cap (30), and a cylinder body (50).

CITATION LIST

Patent Literature

[Patent Literature 1] WO 2015/156085 A1
[Patent Literature 2] WO 2001/000502 A1
[Patent Literature 3] JP 2018-30639 A

SUMMARY

An object of the present invention is to provide a technique for facilitating the assembly of a beverage container including an outer container, a fitting, and a replaceable component having a bag.

A beverage container according to some embodiments includes an outer container having a first mouth portion, a fitting having a beverage extraction pipe, and a replaceable component attached to the beverage extraction pipe and arranged in an inner space of the outer container. The fitting includes an attachment portion attached to the first mouth portion of the outer container, a second mouth portion connectable to a beverage filling nozzle or a dispense head, an annular portion extending outward from the second mouth portion and connecting the second mouth portion and the attachment portion, and the beverage extraction pipe extending toward a bottom of the outer container. The replaceable component includes a sealing member slidable along a longitudinal direction of the beverage extraction pipe and being in annular contact with an outer surface of the beverage extraction pipe at an installation position, a tubular body holding the sealing member and being supported by the beverage extraction pipe via the sealing member located at the installation position, and a bag for containing a beverage attached to the tubular body.

A method of assembling a beverage container according to some embodiments includes: preparing an outer container having a first mouth portion; preparing a fitting having an attachment portion attachable to the first mouth portion, a second mouth portion connectable to a beverage filling nozzle or a dispense head, an annular portion extending outward from the second mouth portion connecting the second mouth portion and the attachment portion, and a beverage extraction pipe; preparing a replaceable component having a sealing member, a tubular body holding the sealing member, and a bag for containing a beverage attached to the tubular body; attaching the replaceable component to the beverage extraction pipe; inserting the replaceable component and the beverage extraction pipe into the outer container; and attaching the attachment portion of the fitting to the first mouth portion of the outer container. The attaching the replaceable component to the beverage extraction pipe includes: sliding the sealing member and the tubular body along a longitudinal direction of the beverage extraction pipe; and making the sealing member into annular contact with an outer surface of the beverage extraction pipe at an installation position. The inserting the replaceable component and the beverage extraction pipe into the outer container includes: inserting a whole of the beverage extraction pipe, the sealing member, the tubular body supported by the beverage extraction pipe via the sealing member, and the bag attached to the tubular body into the outer container through the first mouth portion.

According to the present invention, it is possible to provide a technique for facilitating the assembly of a beverage container including an outer container, a fitting, and a replaceable component having a bag.

DESCRIPTION OF EMBODIMENTS

Figure 1:
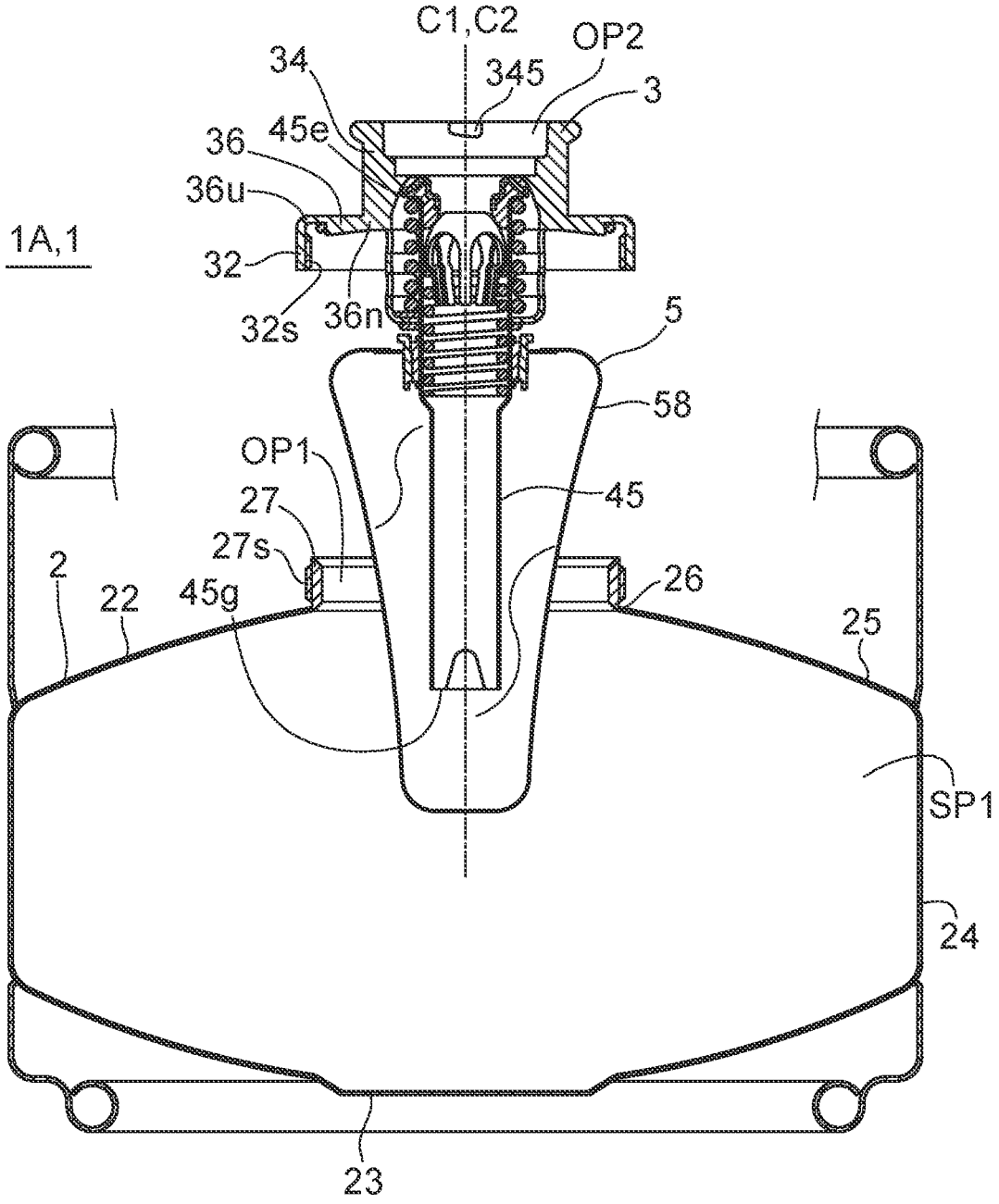
FIG. 1 is a schematic cross-sectional view schematically showing a beverage container according to a first embodiment.

Hereinafter, a beverage container 1 and a method of assembling the beverage container 1 according to some embodiments will be described with reference to the drawings. In the following description, members and portions having the same functions are denoted by the same reference numerals, and repeated descriptions of members and portions denoted by the same reference numerals are omitted.

(Definition of Direction)

In this specification, a direction from a bottom portion 23 of an outer container 2 toward a first mouth portion 27 of the outer container 2 is defined as "upward" and a direction from the first mouth portion 27 to the bottom portion 23 is defined as "downward". Therefore, regardless of whether the outer container 2 is in the upright posture or the inverted posture, the direction from the bottom portion 23 to the first mouth portion 27 is "upward". Further, regarding a fitting 3 before being attached to the outer container 2, a direction from a lower end 45*g* of a beverage extraction pipe 45 toward an upper end 45*e* of the beverage extraction pipe 45 is defined as "upward", and a direction from the upper end 45*e* toward the lower end 45*g* is defined as "downward".

In this specification, a term "outward" means a direction away from a central axis C1 of a second mouth portion 34 of the fitting 3 (or a direction away from a central axis C2 of the beverage extraction pipe 45). Further, a term "inward" means a direction toward the central axis C1 of the second mouth portion 34 of the fitting 3 (or a direction toward the central axis C2 of the beverage extraction pipe 45).

First Embodiment

Figure 2:
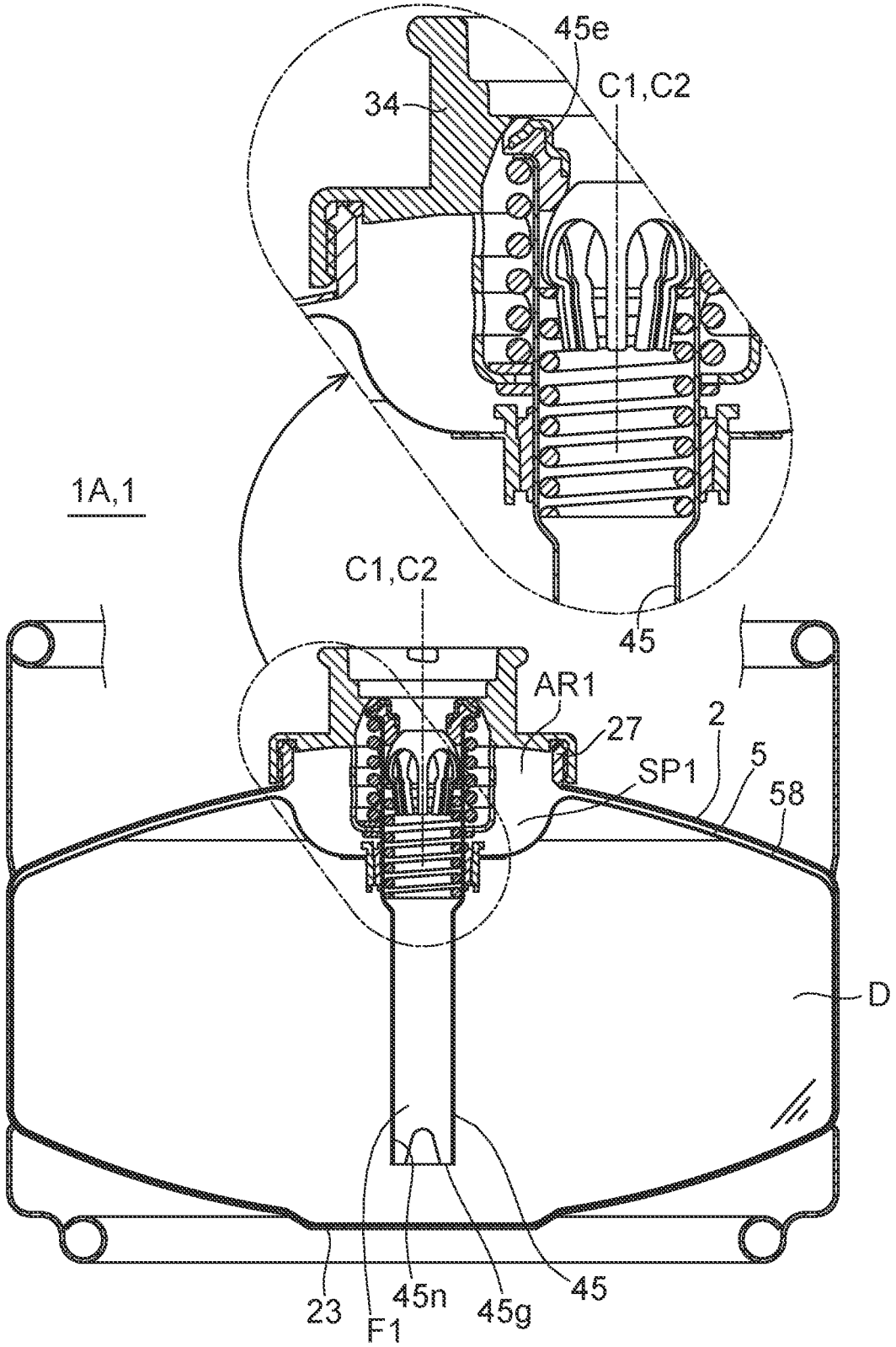
FIG. 2 is a schematic cross-sectional view schematically showing the beverage container according to the first embodiment.
Figure 3:
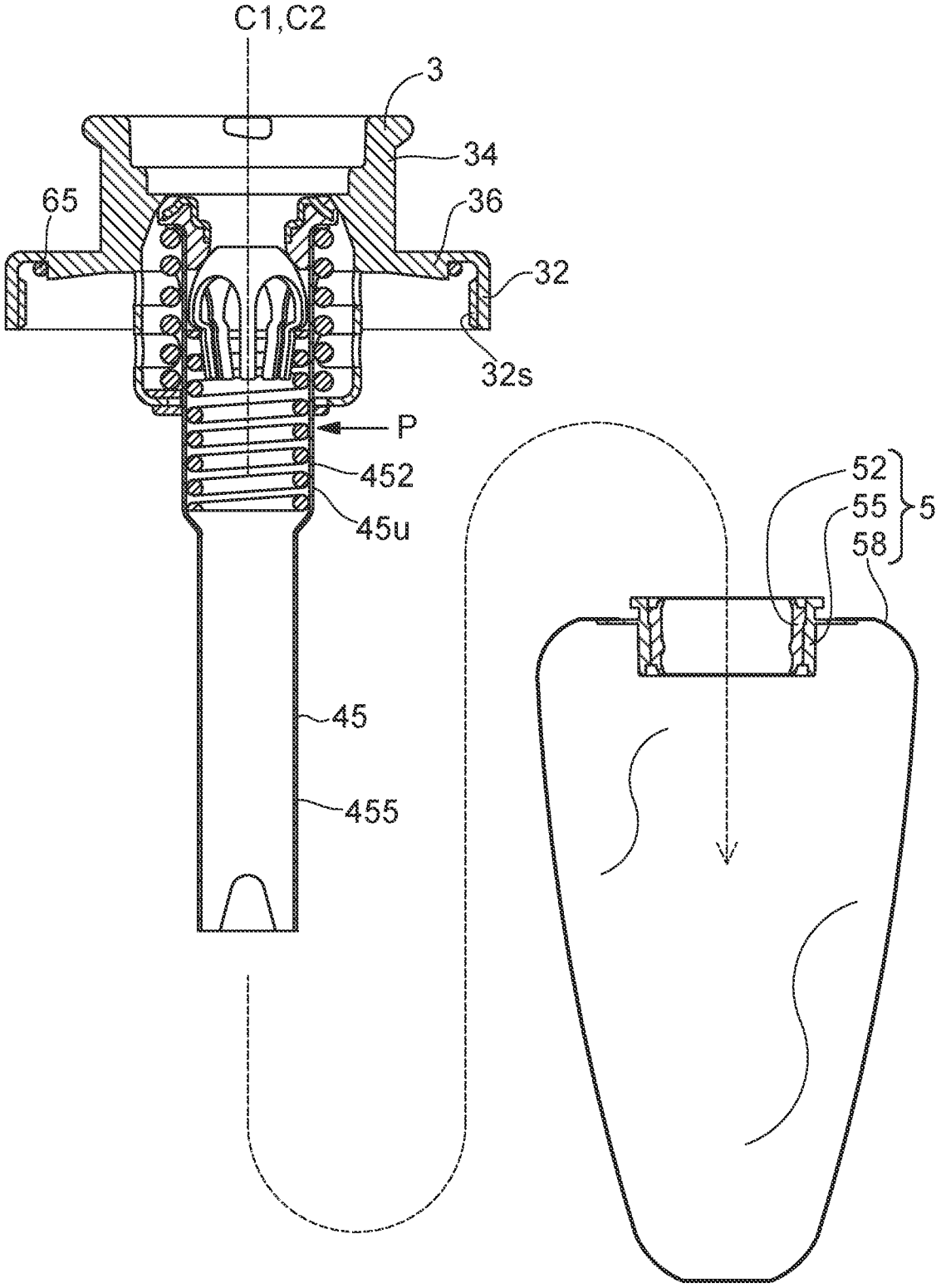
FIG. 3 is a schematic cross-sectional view schematically showing how a replaceable component is attached to a beverage extraction pipe.
Figure 4:
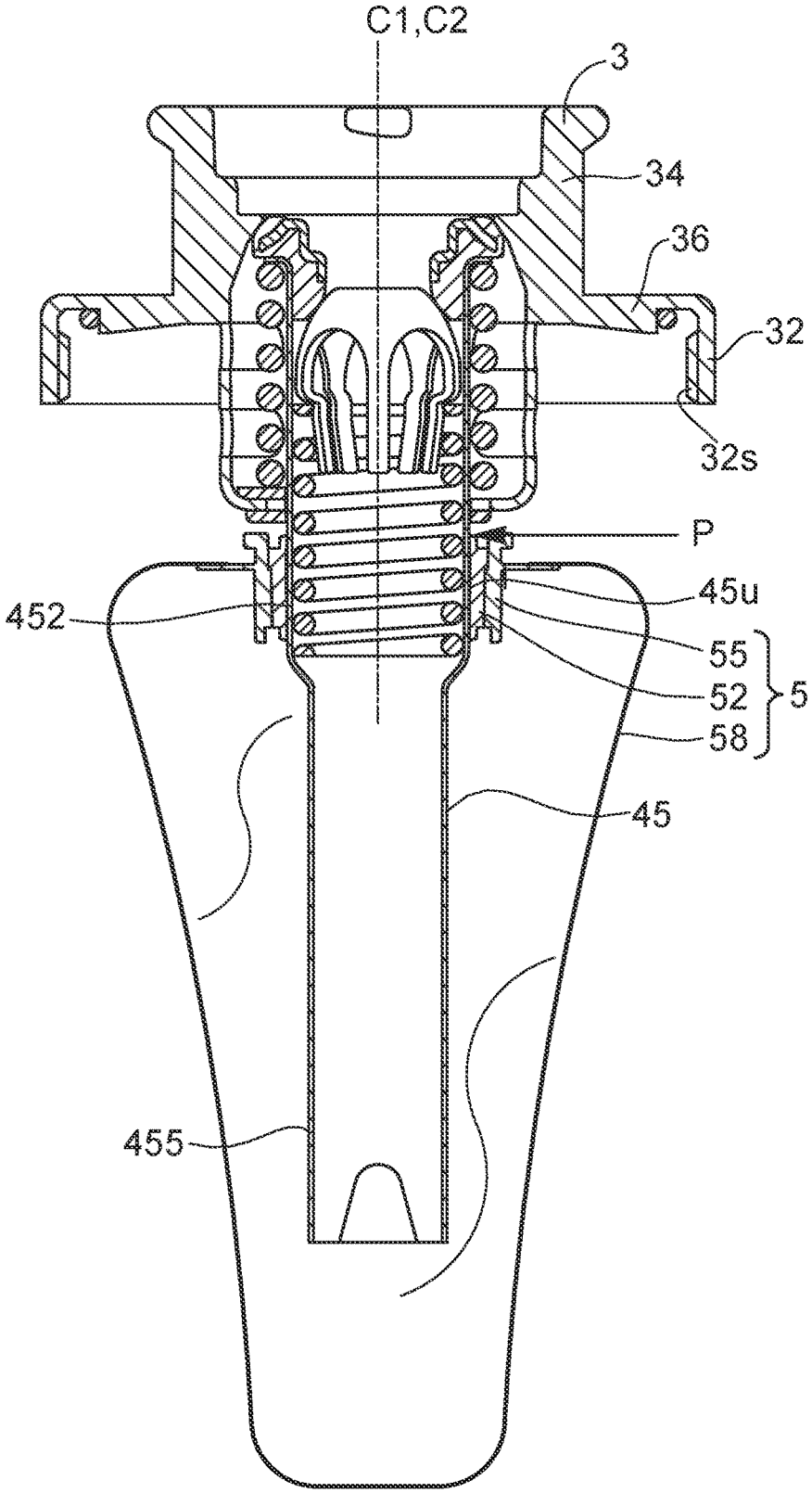
FIG. 4 is a schematic cross-sectional view schematically showing a state after the replaceable component is attached to the beverage extraction pipe.
Figure 5:
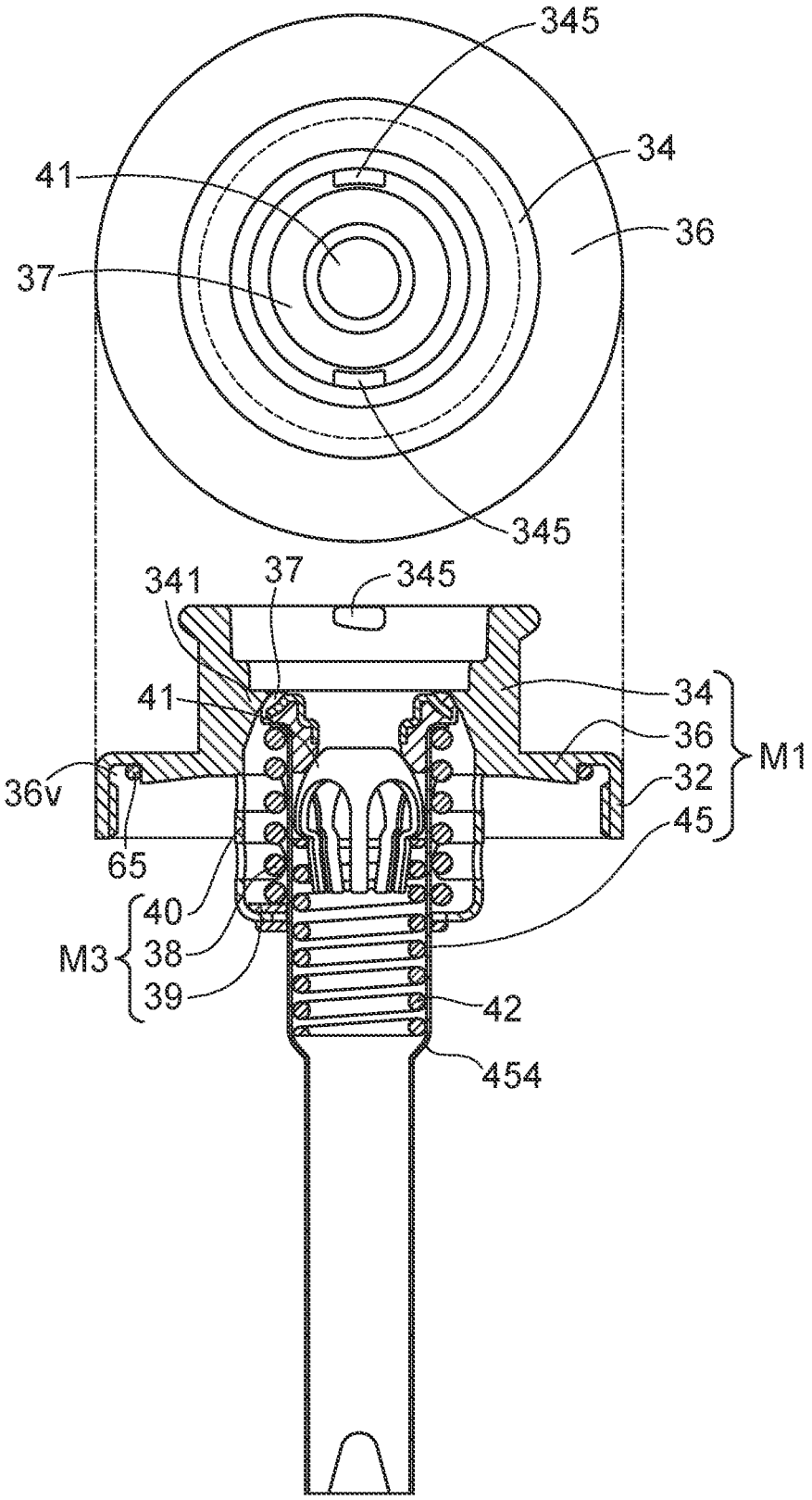
FIG. 5 is a schematic two-view schematically showing an example of a fitting.
Figure 6:
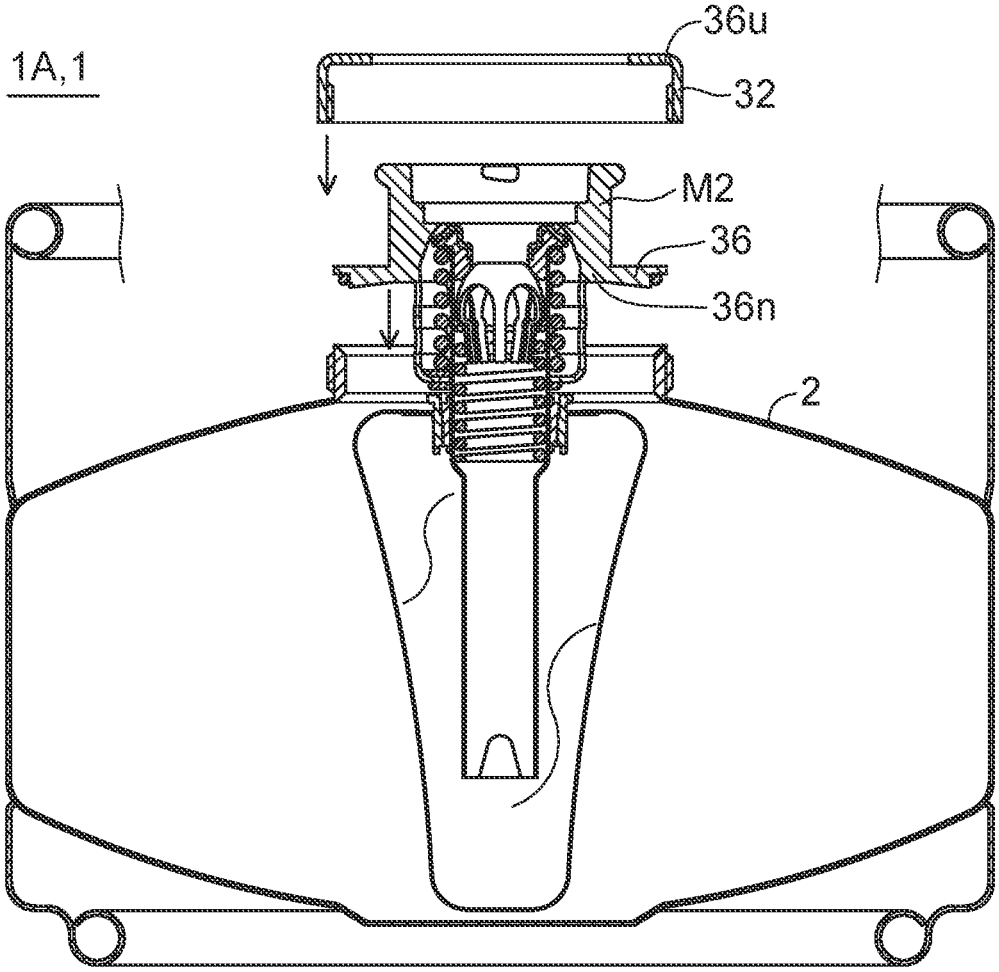
FIG. 6 is a schematic cross-sectional view schematically showing the beverage container according to a first modified example of the first embodiment.
Figure 7:
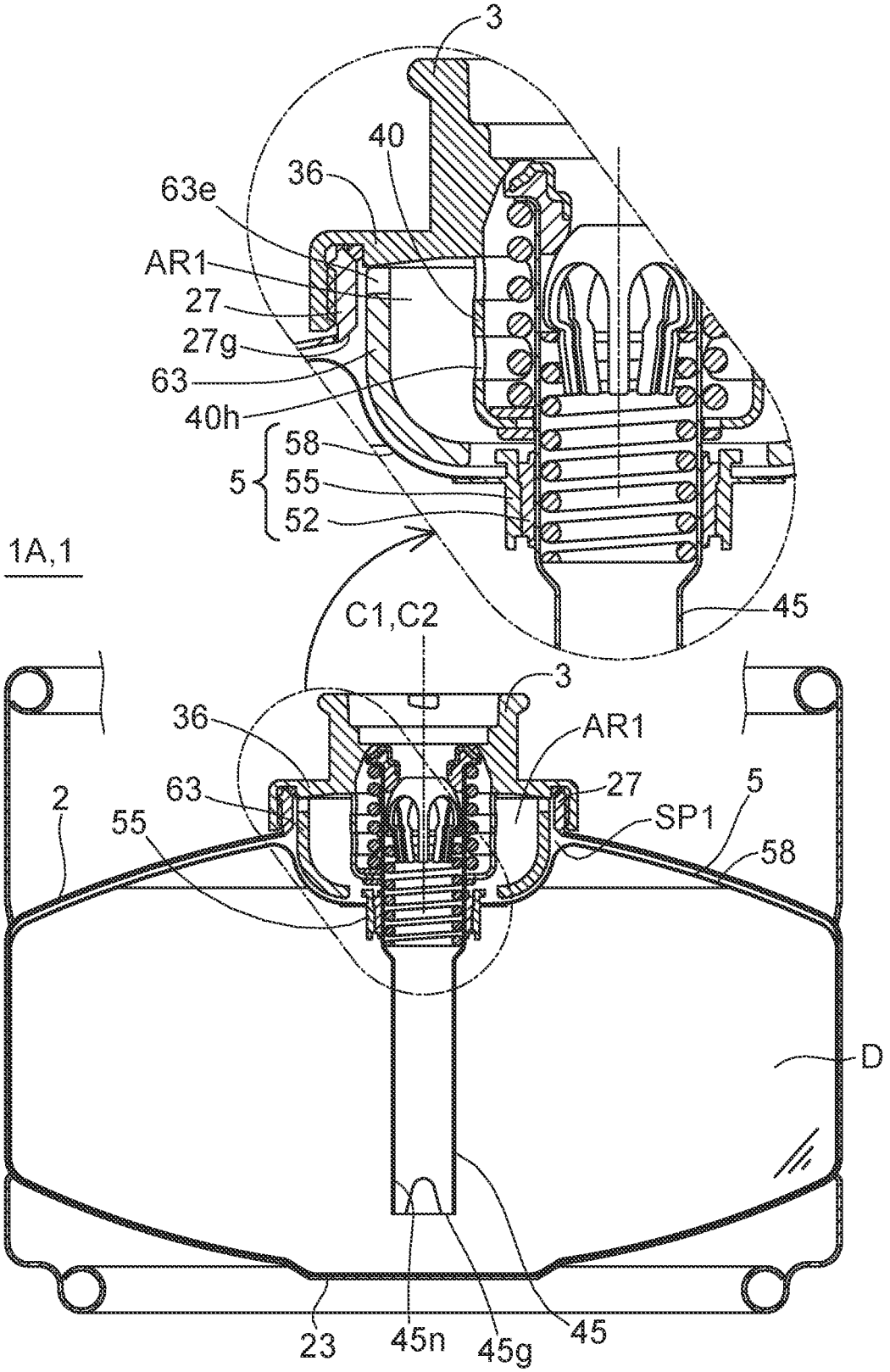
FIG. 7 is a schematic cross-sectional view schematically showing the beverage container according to the first embodiment.
Figure 8:
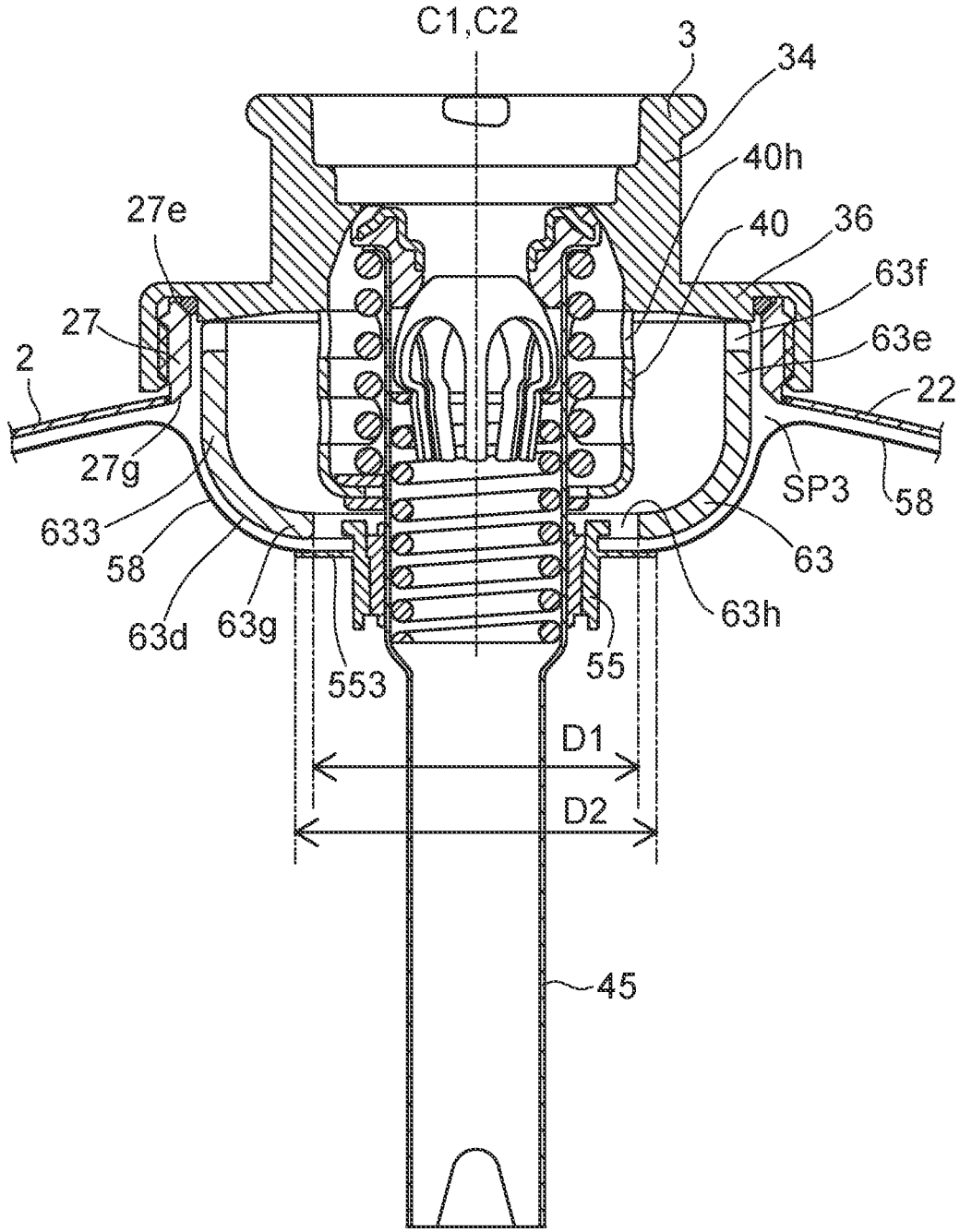
FIG. 8 is a schematic cross-sectional view schematically showing a part of the beverage container according to the first embodiment.
Figure 9:
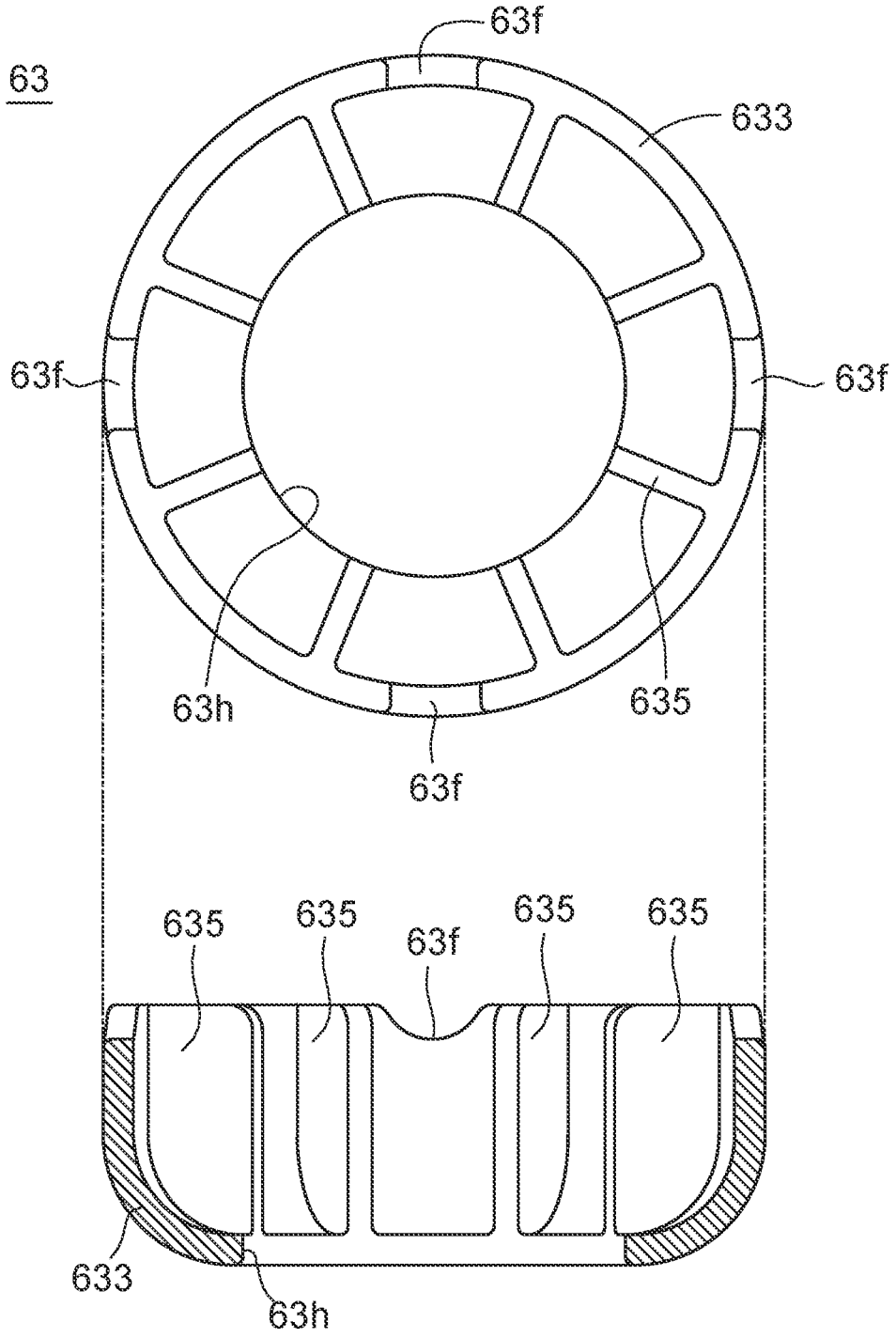
FIG. 9 is a schematic two-view schematically showing an example of a spacer member.
Figure 10:
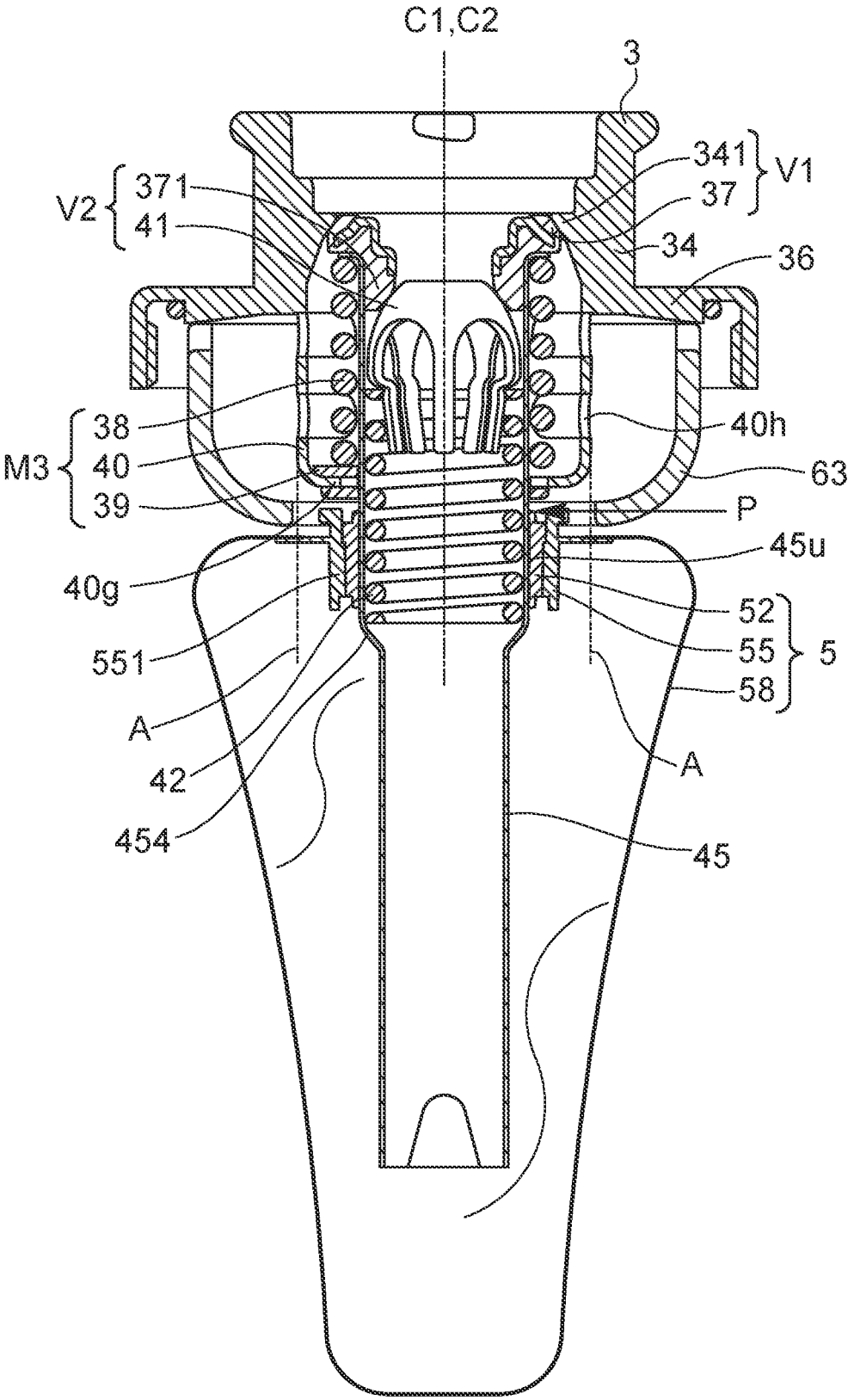
FIG. 10 is a schematic cross-sectional view schematically showing a state after the replaceable component is attached to the beverage extraction pipe.
Figure 11:
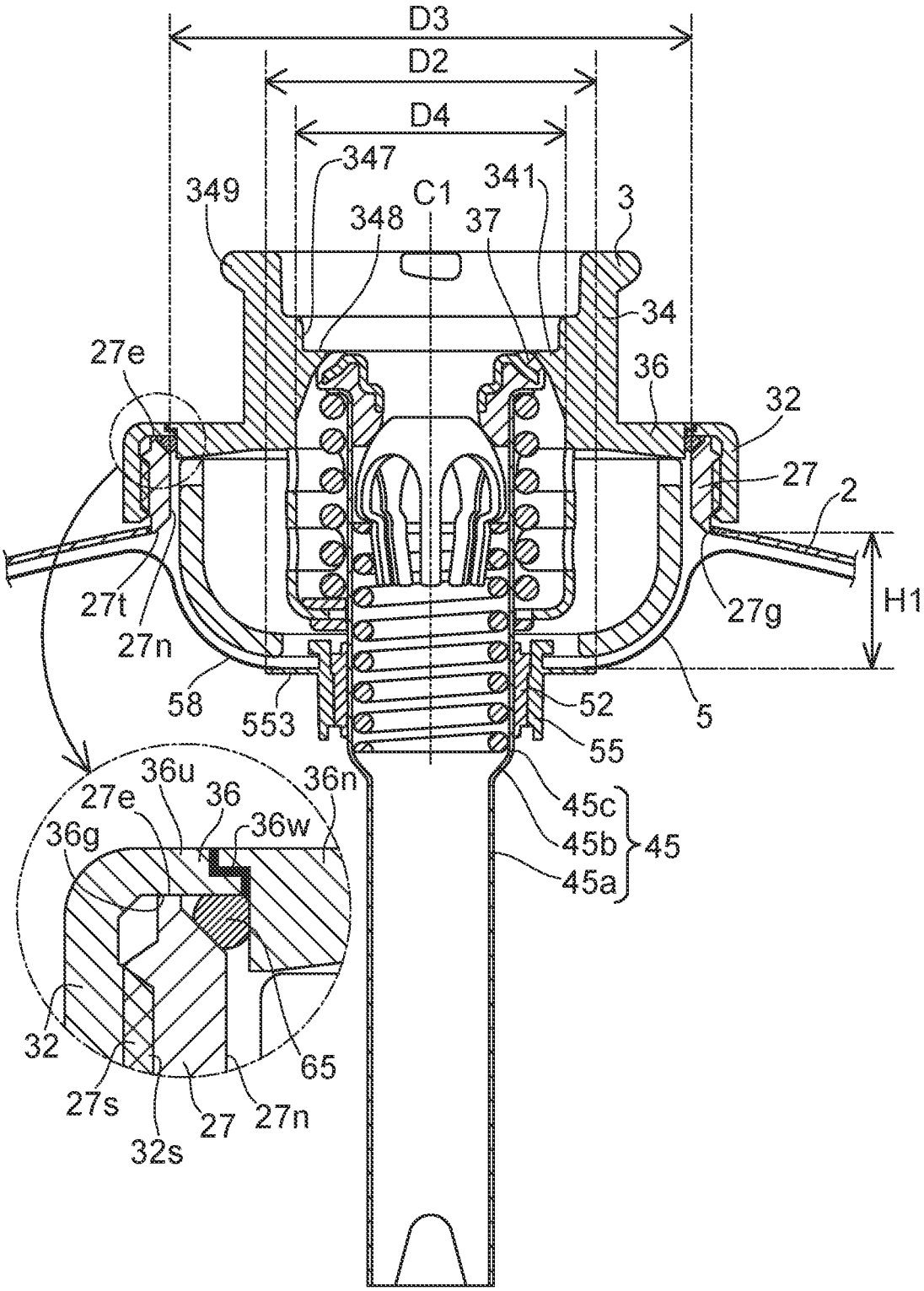
FIG. 11 is a schematic cross-sectional view schematically showing a part of the beverage container according to the first embodiment.
Figure 12:
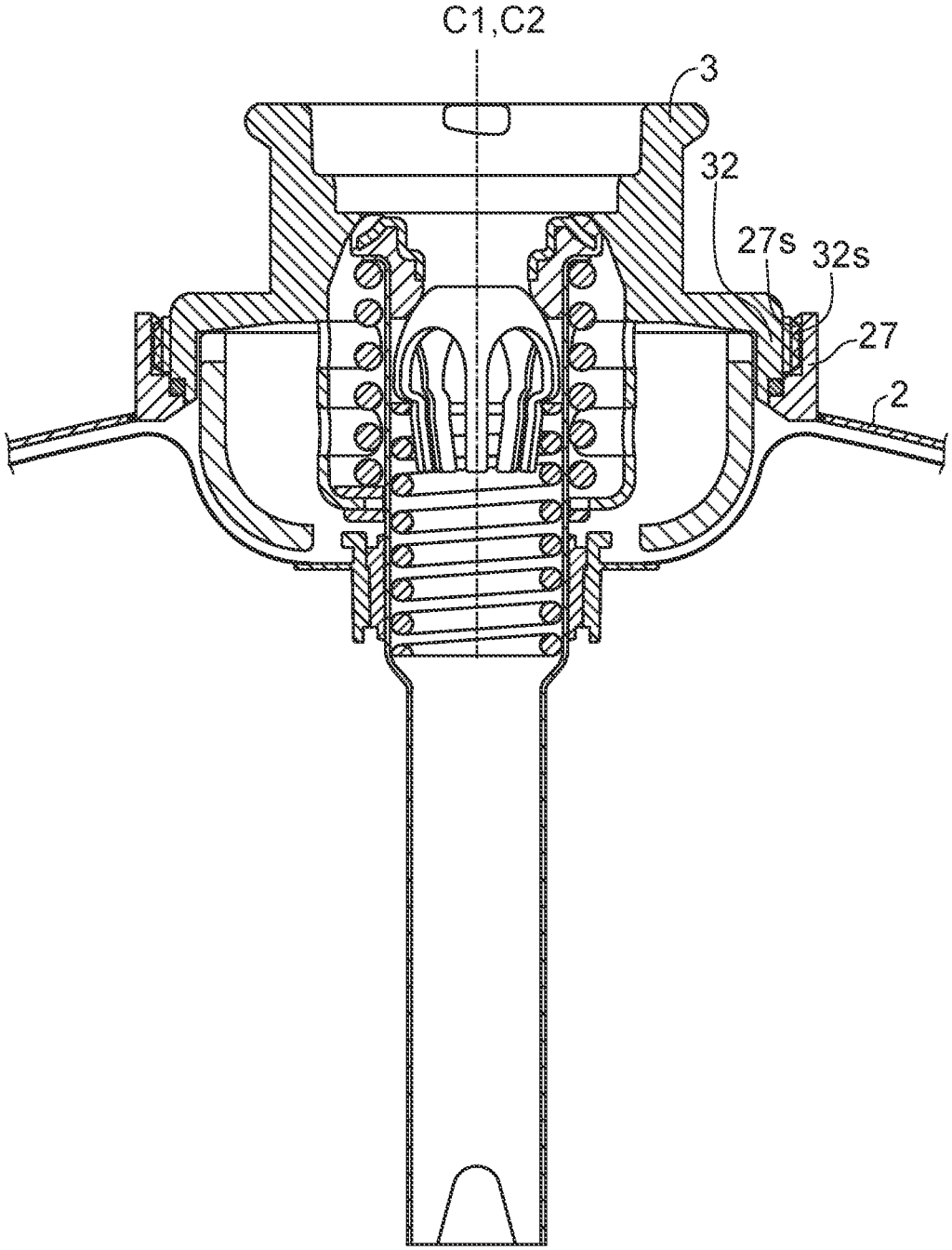
FIG. 12 is a schematic cross-sectional view schematically showing a part of the beverage container according to a second modified example of the first embodiment.
Figure 13:
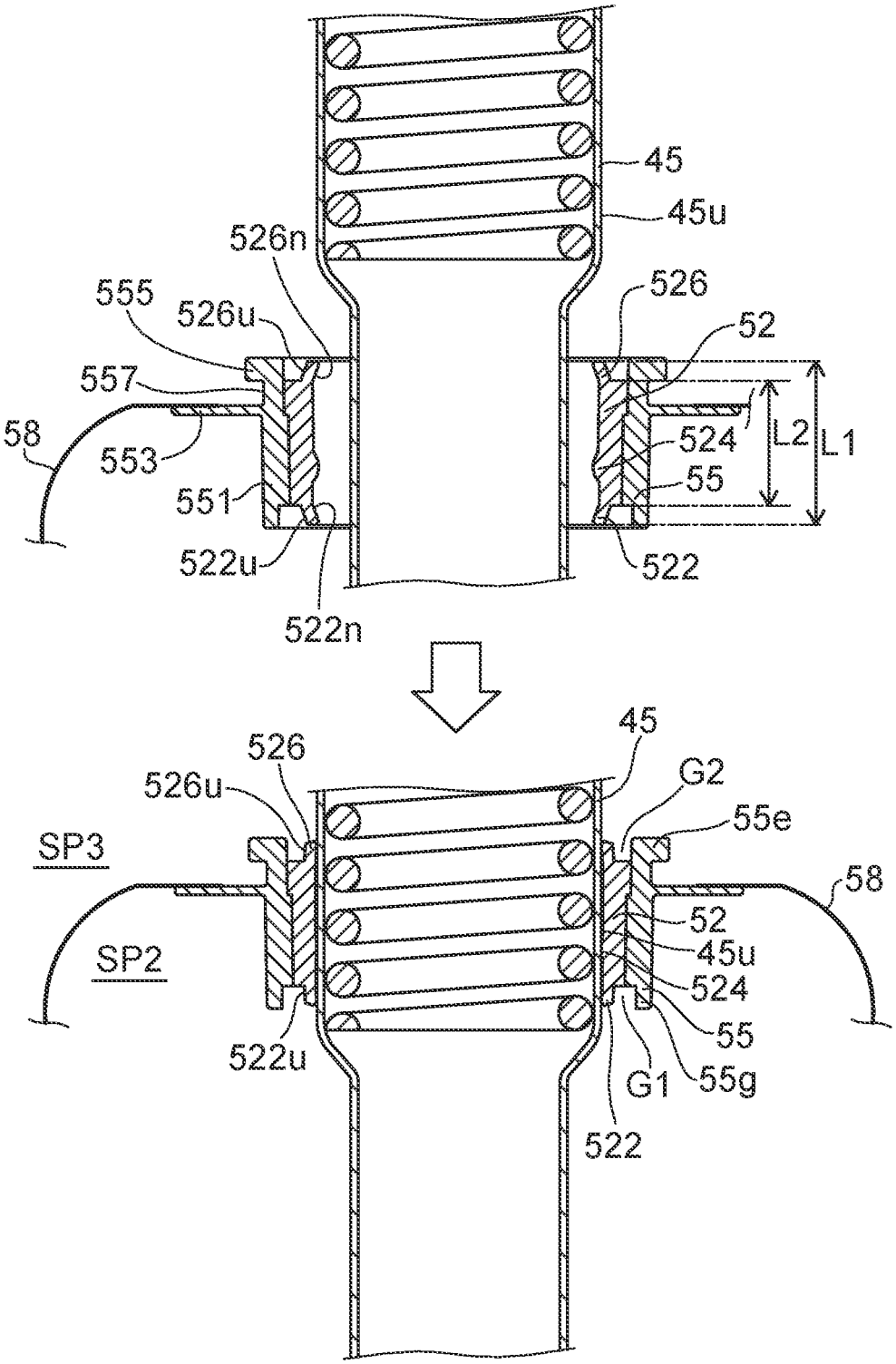
FIG. 13 is a diagram for explaining each element of the replaceable component.
Figure 14:
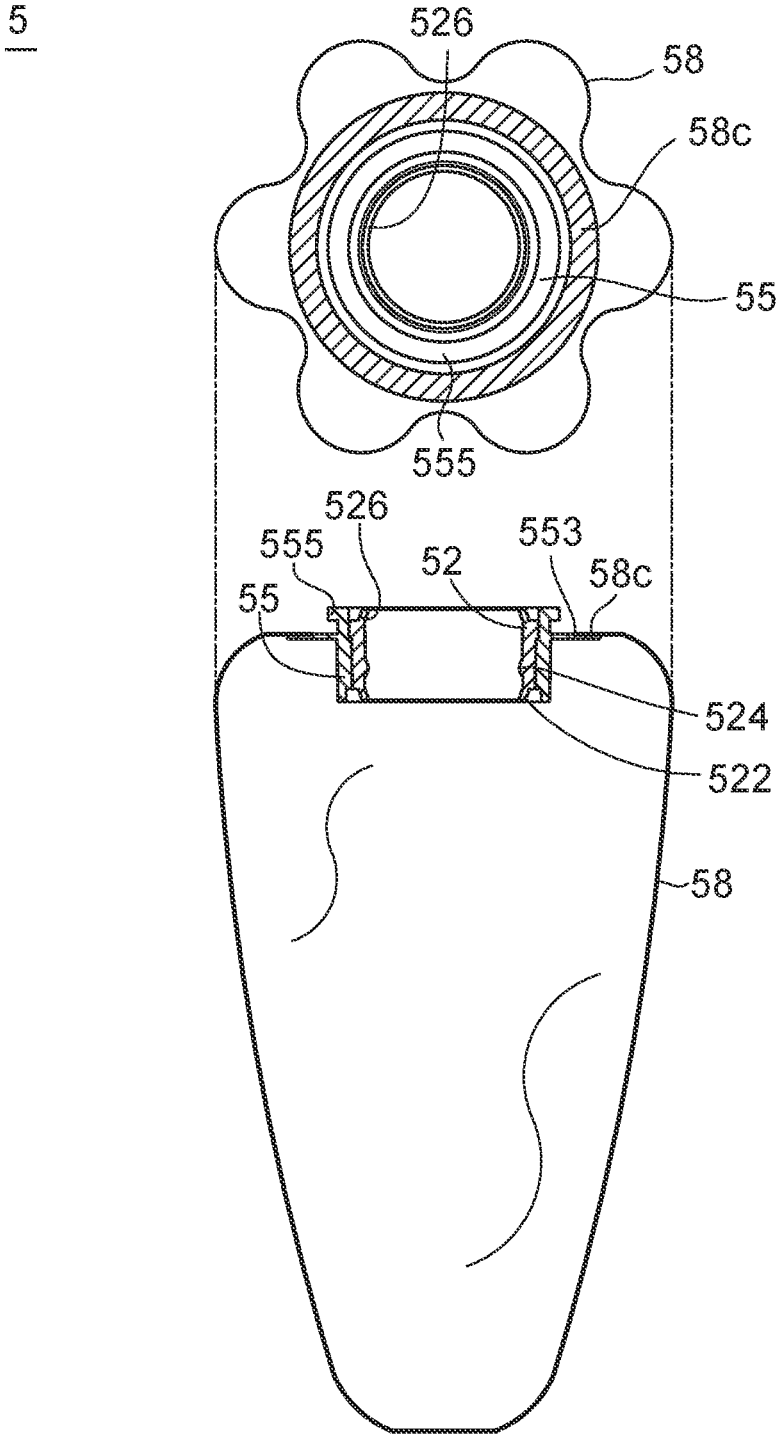
FIG. 14 is a schematic two-view schematically showing an example of the replaceable component.
Figure 15:
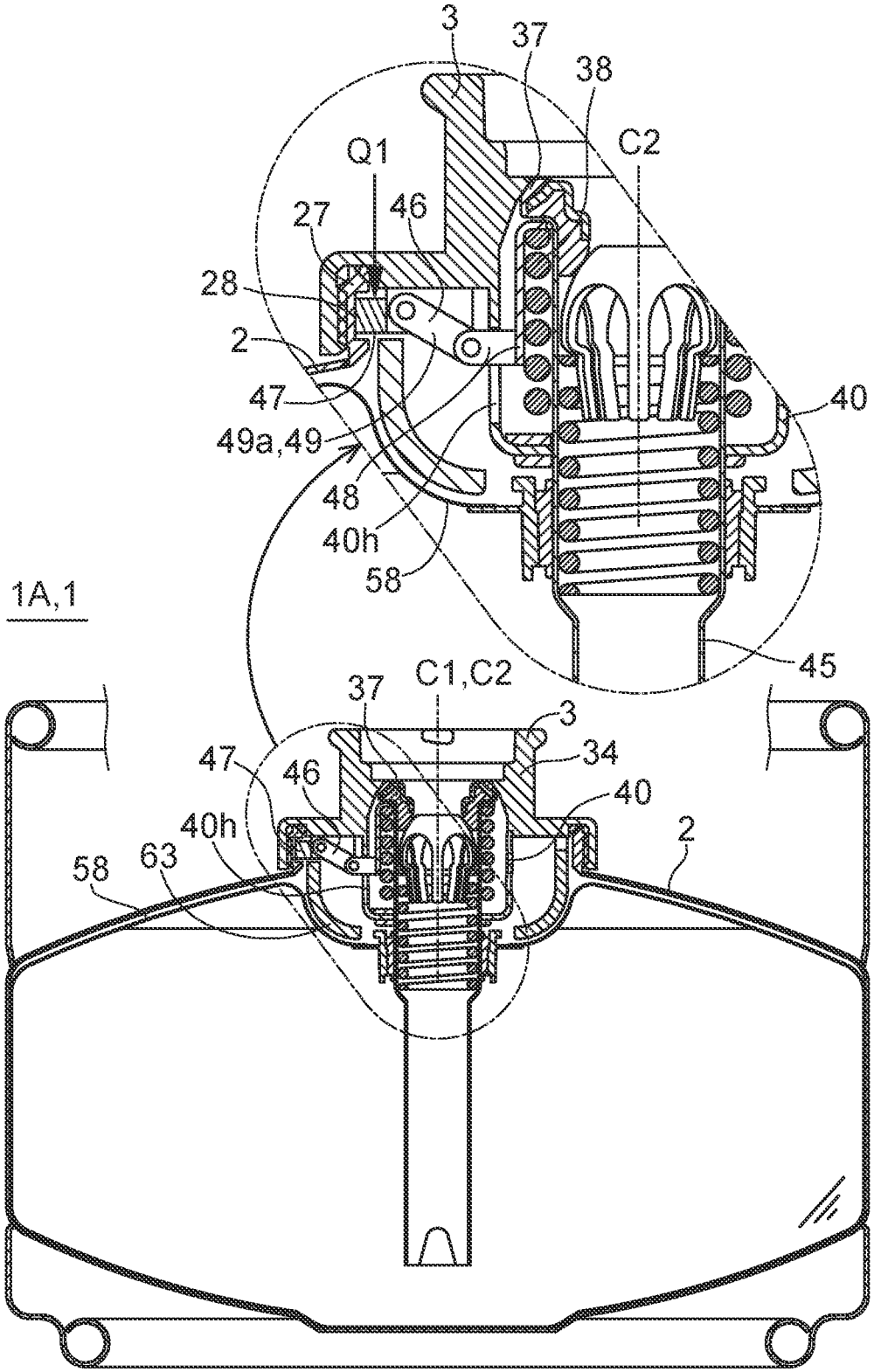
FIG. 15 is a schematic cross-sectional view schematically showing the beverage container according to the first embodiment.
Figure 16:
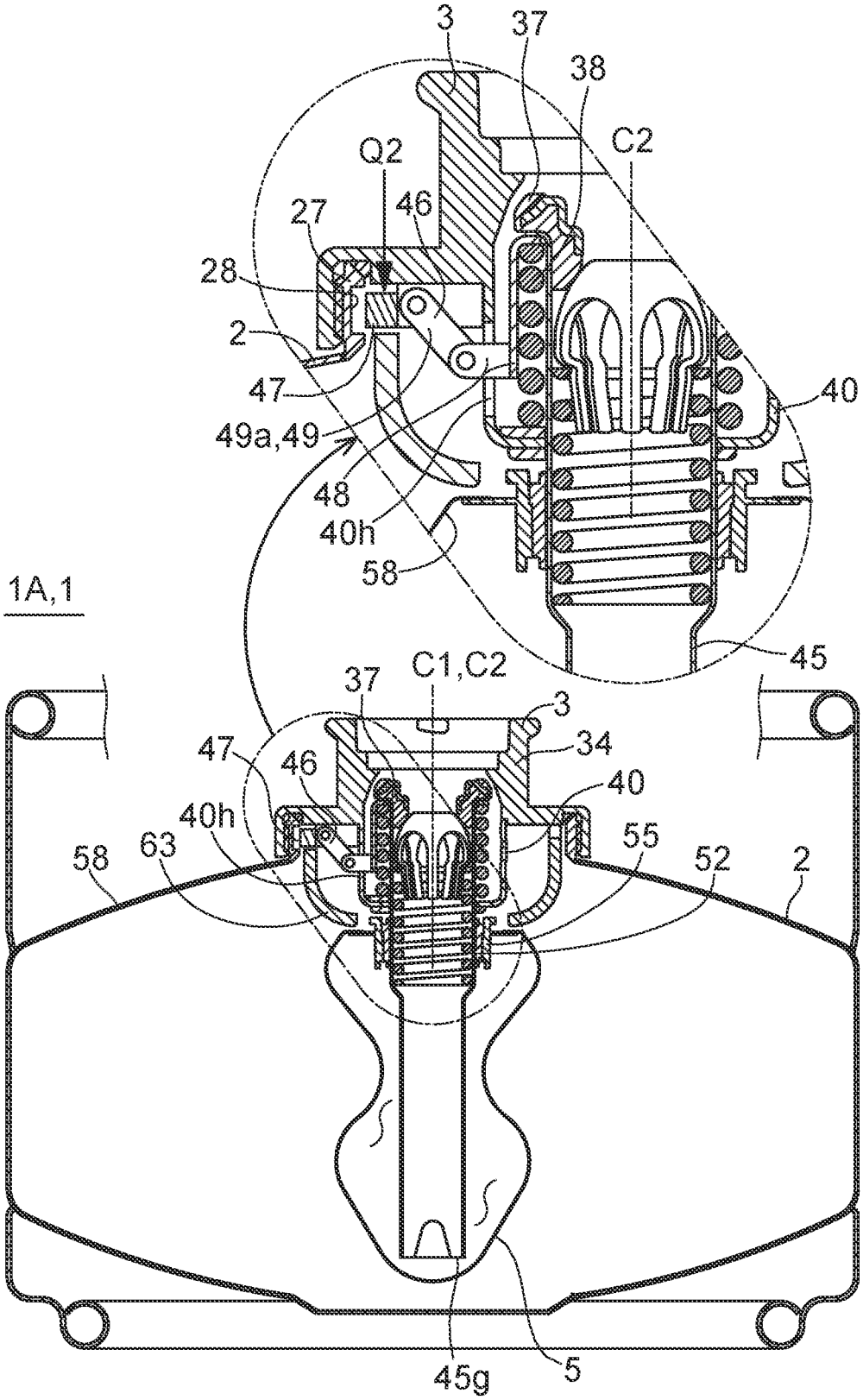
FIG. 16 is a schematic cross-sectional view schematically showing the beverage container according to the first embodiment.
Figure 17:
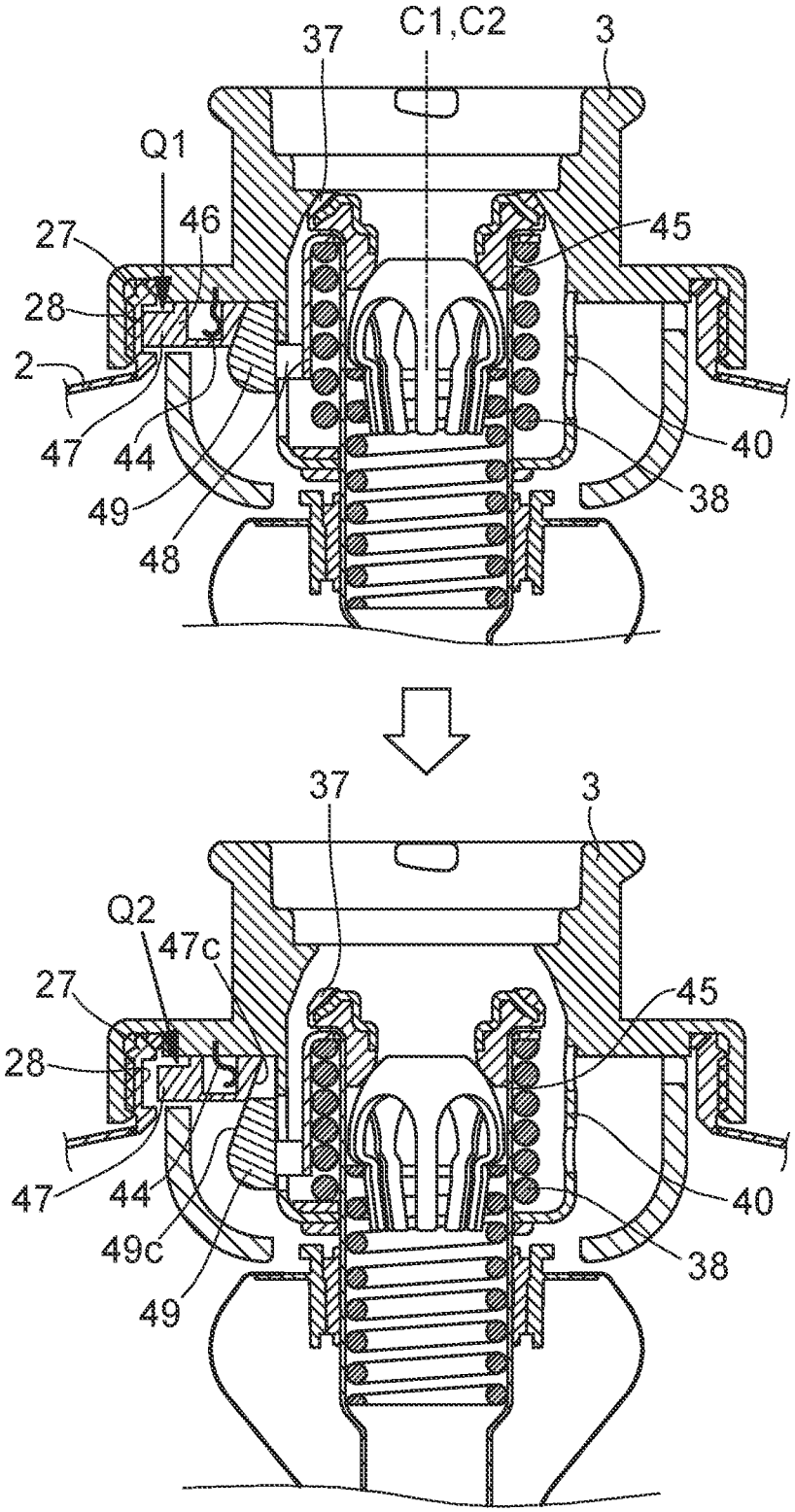
FIG. 17 is a schematic cross-sectional view schematically showing a first modified example of a removal-preventing member.
Figure 18:
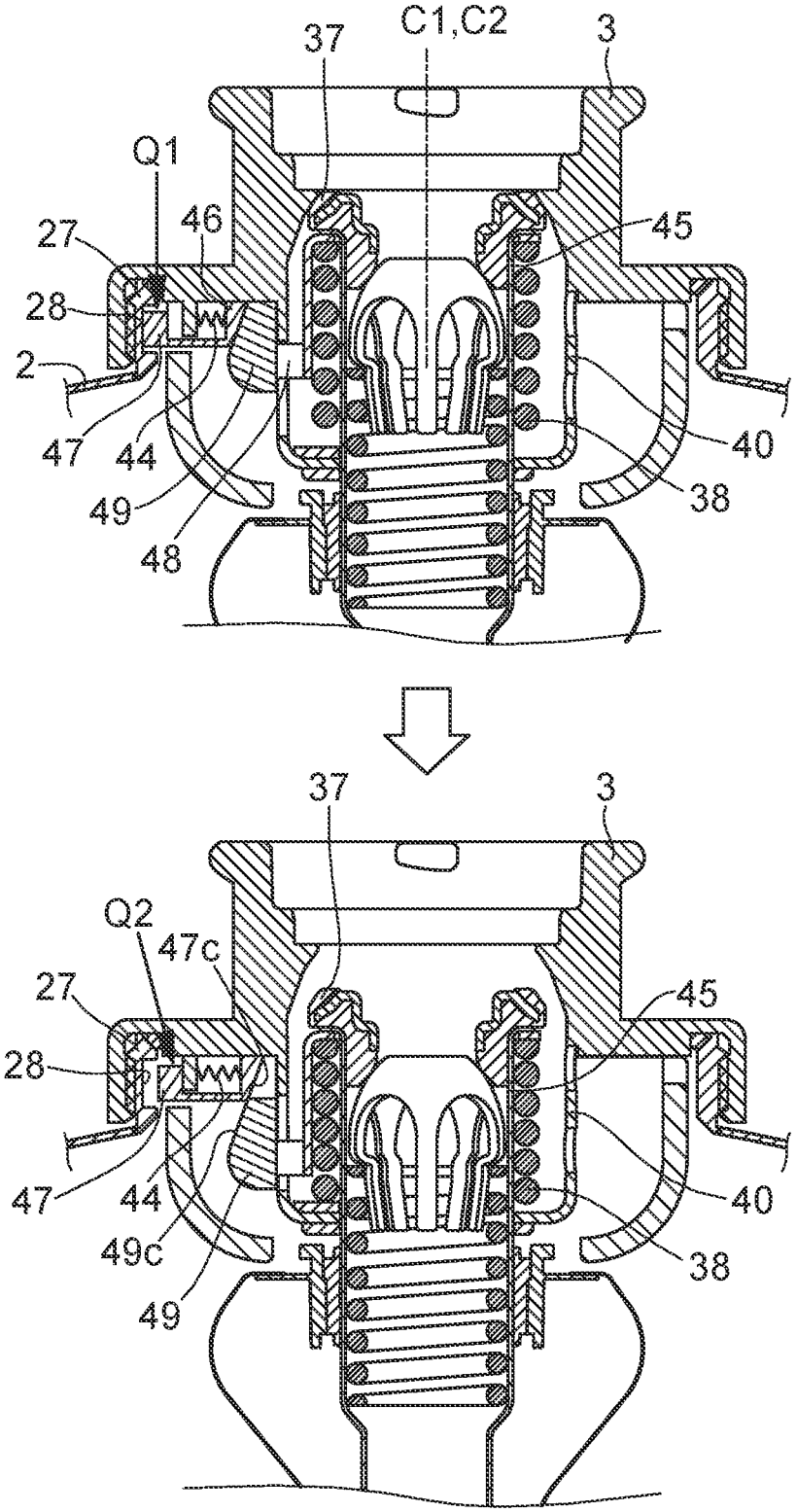
FIG. 18 is a schematic cross-sectional view schematically showing a second modified example of the removal-preventing member.

Referring to FIGS. 1 to 18, a beverage container 1A according to a first embodiment will be described. FIGS. 1 and 2 are schematic cross-sectional views schematically showing a beverage container 1A according to a first embodiment. Note that FIG. 1 shows a state before the beverage container 1A is assembled, and FIG. 2 shows a state after the beverage container 1A is assembled. FIG. 3 is a schematic cross-sectional view schematically showing how a replaceable component 5 is attached to a beverage extraction pipe 45. FIG. 4 is a schematic cross-sectional view schematically showing a state after the replaceable component 5 is attached to the beverage extraction pipe 45. FIG. 5 is a schematic two-view schematically showing an example of a fitting 3. A schematic plan view is shown on the upper side of FIG. 5, and a schematic cross-sectional view is shown on the lower side of FIG. 5. FIG. 6 is a schematic cross-sectional view schematically showing the beverage container 1A according to a first modified example of the first embodiment. FIG. 7 is a schematic cross-sectional view schematically showing the beverage container 1A (an example in which the beverage container 1A includes a spacer member 63) according to the first embodiment. FIG. 8 is a schematic cross-sectional view schematically showing a part of the beverage container 1A according to the first embodiment. FIG. 9 is a schematic two-view schematically showing an example of the spacer member 63. A schematic plan view is shown on the upper side of FIG. 9, and a schematic cross-sectional view is shown on the lower side of FIG. 9. FIG. 10 is a schematic cross-sectional view schematically showing a state after the replaceable component 5 is attached to the beverage extraction pipe 45. FIG. 11 is a schematic cross-sectional view schematically showing a part of the beverage container 1A according to the first embodiment. FIG. 12 is a schematic cross-sectional view schematically showing a part of the beverage container 1A according to a second modified example of the first embodiment. FIG. 13 is a diagram for explaining each element of the replaceable component 5. FIG. 14 is a schematic two-view schematically showing an example of the replaceable component 5. A schematic plan view is shown on the upper side of FIG. 14, and a schematic cross-sectional view is shown on the lower side of FIG. 14. FIGS. 15 and 16 are schematic cross-sectional views schematically showing the beverage container 1A (an example in which the beverage container 1A includes a removal-preventing member 46) according to the first embodiment. FIG. 17 is a schematic cross-sectional view schematically showing a first modified example of the removal-preventing member 46. FIG. 18 is a schematic cross-sectional view schematically showing a second modified example of the removal-preventing member 46.

As shown in FIG. 1, a beverage container 1A includes an outer container 2, a fitting 3, and a replaceable component 5 including a bag 58.

The outer container 2 defines an inner space SP1 in which the replaceable component 5 including the bag 58 is arranged. The outer container 2 has a container main body 22 and a first mouth portion 27. In an example shown in FIG. 1, the first mouth portion 27 extends upward from the container main body 22. The outer container 2 is made of, for example, metal (more specifically, stainless steel). Alternatively, the outer container 2 may be made of resin.

The fitting 3 is attached to the first mouth portion 27. In the example shown in FIG. 1, the first mouth portion 27 has a first threaded portion 27*s* (more specifically, a male threaded portion). The first mouth portion 27 defines a first opening OP1 through which the replaceable component 5 can pass.

The fitting 3 includes an attachment portion 32, a second mouth portion 34, an annular portion 36, and a beverage extraction pipe 45. Note that, in this specification, a "fitting" means a member attached to the first mouth portion of the outer container and used for filling the bag with a beverage and/or taking out a beverage from the bag.

The attachment portion 32 is attached to the first mouth portion 27 of the outer container 2. In the example shown in FIG. 1, the attachment portion 32 has a second threaded portion 32*s* (more specifically, a female threaded portion) threadably engaging with the first threaded portion 27*s* of the first mouth portion 27. The attachment portion 32 is made of, for example, metal (more specifically, stainless steel). Alternatively, the attachment portion 32 may be made of resin.

The second mouth portion 34 can be connected to a beverage filling nozzle or a dispense head. The second mouth portion 34 defines a second opening OP2 through which a tip portion of the beverage filling nozzle (or a tip portion of a plunger member of the dispense head) can pass.

In the example shown in FIG. 1, the second mouth portion 34 has an engaging portion 345 engageable with the dispense head. The second mouth portion 34 is made of, for example, metal (more specifically, stainless steel). Alternatively, the second mouth portion 34 may be made of resin.

The annular portion 36 extends outward from the second mouth portion 34. (In other words, the annular portion 36 extends from the second mouth portion 34 in a direction away from a central axis C1 of the second mouth portion 34). Further, the annular portion 36 connects the second mouth portion 34 and the attachment portion 32. In the example shown in FIG. 1, the annular portion 36 has an inner portion 36*n* connected to the second mouth portion 34 and an outer portion 36*u* connected to the attachment portion 32. In the example shown in FIG. 1, an inner peripheral edge portion of the annular portion 36 is connected to the second mouth portion 34, and an outer peripheral edge portion of the annular portion 36 is connected to the attachment portion 32. An upper surface of the annular portion 36 may be a plane parallel to a horizontal plane or a plane inclined with respect to the horizontal plane.

Since the fitting 3 has the annular portion 36, an inner diameter of the first mouth portion 27 of the outer container 2 can be remarkably larger than an inner diameter of the second mouth portion 34 of the fitting 3. When the inner diameter of the first mouth portion 27 is large, it is easy to insert the replaceable component 5 having the bag 58 into the outer container 2 via the first mouth portion 27.

As shown in FIG. 2, the beverage extraction pipe 45 extends toward a bottom portion 23 of the outer container 2. Further, an upper end 45*e* of the beverage extraction pipe 45 is arranged in a vicinity of the second mouth portion 34. The beverage extraction pipe 45 has an inner surface 45*n* that defines a beverage flow channel F1. When the beverage is taken out of the beverage container 1A, the beverage D in the bag 58 is introduced into the beverage extraction pipe 45, and the beverage D introduced into the beverage extraction pipe 45 flows toward the upper end 45*e* of the beverage extraction pipe 45. The beverage extraction pipe 45 is made of, for example, metal (more specifically, stainless steel). Alternatively, the beverage extraction pipe 45 may be made of resin.

The replaceable component 5 is attached to the beverage extraction pipe 45 and is arranged in the inner space SP1 of the outer container 2. In an example shown in FIG. 2, a whole of the replaceable component 5 and a whole of the beverage extraction pipe 45 are arranged in the inner space SP1 of the outer container 2.

As shown in FIG. 3, the replaceable component 5 includes a sealing member 52, a tubular body 55, and the bag 58. The frequency of replacing the replaceable component 5 is higher than the frequency of replacing the outer container 2 and the fitting 3. By repeatedly reusing the outer container 2 and the fitting 3, the burden on the environment is reduced. When one cycle is defined as from the filling of the beverage into the beverage container 1A to the next filling of the beverage into the beverage container 1A, the replaceable component 5 may be replaced every cycle. In other words, the replaceable component 5 may be a one-time use disposable component.

The sealing member 52 is slidable along a longitudinal direction of the beverage extraction pipe 45. In this case, it is easy to move the sealing member 52 toward an installation position P (more specifically, an upper portion 452 of the beverage extraction pipe 45) on the beverage extraction pipe 45, and it is easy to arrange the sealing member 52 at the installation position P ((more specifically, the upper portion 452 of the beverage extraction pipe 45) on the beverage extraction pipe 45.

At a final stage when the sealing member 52 reaches the installation position P, the sealing member 52 slides with respect to the beverage extraction pipe 45 in a state where an outer surface 45*u* of the beverage extraction pipe 45 and the sealing member 52 are in annular contact with each other. In other words, at the final stage when the sealing member 52 reaches the installation position P, an appropriate frictional resistance is generated between the sealing member 52 and the beverage extraction pipe 45. Note that if the frictional resistance is too small, the sealing member 52 may be determined to be a defective product.

As shown in FIG. 4, the sealing member 52 is in annular contact with the outer surface 45*u* of the beverage extraction pipe 45 when it is located at the installation position P. This contact prevents fluid (in other words, the beverage or a gas) from leaking from between the sealing member 52 and the beverage extraction pipe 45. The sealing member 52 is made of an elastic material such as rubber.

The tubular body 55 is arranged outside the sealing member 52 and holds the sealing member 52. When the sealing member 52 is located at the installation position P on the beverage extraction pipe 45, the tubular body 55 prevents an outer diameter of the sealing member 52 from increasing. In this way, the sealing member 52 arranged between the tubular body 55 and the outer surface 45*u* of the beverage extraction pipe 45 is compressed, and the sealing effect of the sealing member 52 is improved.

As shown in FIG. 4, the tubular body 55 is supported by the beverage extraction pipe 45 via the sealing member 52 located at the installation position P. Further, the bag 58 for accommodating the beverage is attached to the tubular body 55. The beverage contained in the bag 58 is, for example, an alcoholic beverage such as beer, or an effervescent beverage such as beer or non-alcoholic beer.

In an example shown in FIG. 4, when the sealing member 52 is located at the installation position P, the tubular body 55 to which the bag 58 is attached is supported by the beverage extraction pipe 45 via the sealing member 52. In other words, only by moving the sealing member 52 to the installation position P, the replaceable component 5 including the bag 58 is supported by the beverage extraction pipe 45. Therefore, the configuration for preventing the replaceable component 5 from falling off from the beverage extraction pipe 45 is simple.

In the first embodiment, by sliding the sealing member 52 toward the installation position P on the beverage extraction pipe 45, the replaceable component 5 having the sealing member 52 is attached to the beverage extraction pipe 45. Therefore, it is easy to attach the replaceable component 5 to the beverage extraction pipe 45 (see FIGS. 3 and 4).

Further, in the first embodiment, the replaceable component 5 having the bag 58 is attached to the beverage extraction pipe 45. In this case, the bag 58 can be compactly arranged around the beverage extraction pipe 45. Therefore, the replaceable component 5 having the bag 58 and the beverage extraction pipe 45 to which the replaceable component 5 is attached can be easily inserted into the outer container 2 (see FIG. 1).

Further, in the first embodiment, the fitting 3 has the annular portion 36. Due to the presence of the annular portion 36, the inner diameter of the first mouth portion 27 of the outer container 2 can be remarkably larger than the inner diameter of the second mouth portion 34 of the fitting 3. When the inner diameter of the first mouth portion 27 is large, it is easy to insert the replaceable component 5 having the bag 58 into the outer container 2 through the first mouth portion 27 (see FIG. 1).

As mentioned above, in the first embodiment, the beverage container 1A that is easy to assemble is provided.

Subsequently, with reference to FIGS. 1 to 18, optional configurations that can be adopted in the first embodiment will be described.

(Outer Container 2)

In the example shown in FIG. 1, the outer container 2 is a rigid container (in other words, a container whose shape does not substantially change). The container main body 22 of the outer container 2 has the bottom portion 23 and a body portion 24. The container main body 22 may have an upper plate portion 25 that connects the body portion 24 and the first mouth portion 27. In the example shown in FIG. 1, the upper plate portion 25 and the first mouth portion 27 are connected via a welded portion 26.

(Fitting 3)

In an example shown in FIG. 5, the fitting 3 is an assemble body M1 including the attachment portion 32, the second mouth portion 34, the annular portion 36, and the beverage extraction pipe 45. The assemble body M1 may include a first valve member 37 described later, a first spring 38 described later, and a first spring receiver 39 described later. Further, the assemble body M1 may include a second valve member 41 described later, a second spring 42 described later, and a second spring receiver 454 described later.

It is preferable that the fitting 3 assembled in the assemble body M1 is attached to the first mouth portion 27 of the outer container 2 so that the whole of the fitting 3 is attached to the outer container 2. In this case, it is not necessary to separately place each member constituting the fitting 3 to the outer container 2.

Alternatively, as shown in FIG. 6, the fitting 3 may be divided into a plurality of parts. In an example shown in FIG. 6, the attachment portion 32 and a assemble body M2 of the fitting 3 excluding the outer portion 36*u* of the annular portion 36 are placed to the outer container 2, and then the attachment portion 32 constituting a part of the fitting 3 is attached to the outer container 2. In the example shown in FIG. 6, the inner portion 36*n* of the annular portion 36 and the outer portion 36*u* of the annular portion 36 are separate bodies. Further, when the attachment portion 32 is attached to the first mouth portion 27 of the outer container 2, the inner portion 36*n* of the annular portion 36 and the outer portion 36*u* of the annular portion 36 are connected by pressing force.

(Spacer Member 63)

In an example shown in FIG. 7, the beverage container 1A includes a spacer member 63 arranged between the annular portion 36 and the tubular body 55. The spacer member 63 prevents over-deformation (excessive-deformation) of the bag 58 toward the annular portion 36. In the example shown in FIG. 7, the spacer member 63 is not attached to the tubular body 55. In other words, the tubular body 55 is movable relative to the spacer member 63. In this case, the spacer member 63 and the replaceable component 5 having the tubular body 55 can be handled separately. For example, the frequency of replacing the spacer member 63 can be made lower than the frequency of replacing the replaceable component 5.

The spacer member 63 is preferably a non-flexible member (in other words, a member whose substantial deformation is suppressed). The spacer member 63 may be made of resin, or may be made of metal such as stainless steel.

In the example shown in FIG. 2, when an internal pressure of the bag 58 increases, a part of the bag 58 enters an annular region AR1 inside the first mouth portion 27, and the bag 58 is over-deformed upward. In addition, the bag 58 may be damaged due to over-deformation of the bag 58. On the other hand, the spacer member 63 prevents the bag 58 from being over-deformed toward the annular portion 36 since the spacer member occupies a part of the annular region AR1 inside the first mouth portion 27.

In the example shown in FIG. 7, the spacer member 63 prevents the bag 58 from coming into contact with an outer cylindrical portion 40 described later. In this case, damage to the bag 58 due to contact between the bag 58 and the outer cylindrical portion 40 (more specifically, a through hole portion 40*h* formed in the outer cylindrical portion 40) is prevented.

In the example shown in FIG. 7, the spacer member 63 has an upper end portion 63*e* located above a lower end 27*g* of the first mouth portion 27. The upper end portion 63*e* is arranged in the annular region AR1 between the first mouth portion 27 and the outer cylindrical portion 40. The upper end portion 63*e* of the spacer member 63 may be contactable to the annular portion 36 of the fitting 3.

In the example shown in FIG. 7, the spacer member 63 is arranged so as to surround the outer cylindrical portion 40, and a lower end of the spacer member 63 is located below a lower end of the outer cylindrical portion 40. In this case, the spacer member 63 can effectively prevent the bag 58 from coming into contact with the outer cylindrical portion 40 (more specifically, the through hole portion 40*h*).

In an example shown in FIG. 8, the spacer member 63 has a lower end portion 63*g* extending inward toward the beverage extraction pipe 45. In the example shown in FIG. 8, the lower end portion 63*g* of the spacer member 63 is located below the lower end 27*g* of the first mouth portion 27. It is preferable that the lower end portion 63*g* of the spacer member 63 is contactable to the tubular body 55 (more specifically, a first flange 553 of the tubular body 55) of the replaceable component 5.

In the example shown in FIG. 8, the spacer member 63 has a lower surface 63*d* which is arranged to face the bag 58. The lower surface 63*d* is preferably an inclined surface (more specifically, an inclined convex surface) whose height increases as a distance from the central axis C2 of the beverage extraction pipe 45 increases. In this case, when the internal pressure of the bag 58 increases, the bag 58 is gently deformed along the lower surface 63*d* of the spacer member 63. As a result, over-deformation of the bag 58 is prevented, and damage to the bag 58 is prevented even more effectively.

In the example shown in FIG. 8, the spacer member 63 has a through hole portion 63*h* into which the beverage extraction pipe 45 is inserted. The through hole portion 63*h* may be able to receive an upper end portion of the tubular body 55 of the replaceable component 5.

In the example shown in FIG. 8, the tubular body 55 can move relative to the spacer member 63 in a vertical direction. When the tubular body 55 moves upward beyond the through hole portion 63*h* of the spacer member 63, the bag 58 may be damaged by an inner edge of the through hole portion 63*h* or an outer edge of the tubular body 55. Therefore, in the example shown in FIG. 8, an inner diameter D1 of the through hole portion 63*h* of the spacer member 63 is set to a smaller value than a maximum outer diameter D2 of the tubular body 55 (more specifically, an outer diameter of the first flange 553). In the example shown in FIG. 8, the first flange 553 of the tubular body 55 cannot move upward beyond the through hole portion 63*h* of the spacer member 63.

In the example shown in FIG. 8, the spacer member 63 is movable relative to the fitting 3. Alternatively, the spacer member 63 may be fixed to the fitting 3. For example, the spacer member 63 may be fixed to the annular portion 36 of the fitting 3 by engagement (for example thread engagement) or welding.

In the example shown in FIG. 8, a recess portion 63*f* that allows the passage of gas is formed in the upper end portion 63*e* of the spacer member 63. In this case, the gas supplied from the outside of the outer container 2 can enter a space SP3 between the container main body 22 of the outer container 2 and the bag 58 through the recess portion 63*f*. In this way, the beverage inside the bag 58 can be pushed out of the bag 58 by using the pressure of the gas entering the space SP3. Alternatively, an outer shell portion 633 of the spacer member 63 may be provided with a through hole portion that allows the passage of gas, apart from the above-mentioned through hole portion 63*h*.

As shown in FIG. 9, the spacer member 63 may have the outer shell portion 633 and reinforcing ribs 635 arranged inside the outer shell portion 633. The reinforcing ribs 635 reinforce the outer shell portion 633 and suppress the deformation of the outer shell portion 633.

(First Valve Seat Portion 341 and First Valve Member 37)

In an example shown in FIG. 10, the fitting 3 has a first valve seat portion 341 and the first valve member 37. Further, a gas valve V1 is constituted by the first valve seat portion 341 and the first valve member 37. The gas valve V1 is a valve whose state can be changed between an open state that allows the passage of gas and a closed state that prohibits the passage of gas.

In the example shown in FIG. 10, the first valve seat portion 341 is formed in the second mouth portion 34. More specifically, a part of an inner peripheral surface of the second mouth portion 34 functions as the first valve seat portion 341. The first valve seat portion 341 is constituted by, for example, an inclined surface whose inner diameter increases in a downward direction.

The first valve member 37 is contactable to the first valve seat portion 341 and is separable from the first valve seat portion 341. A state in which the first valve member 37 is in contact with the first valve seat portion 341 corresponds to the closed state of the gas valve V1, and a state in which the first valve member 37 is separated from the first valve seat portion 341 corresponds to the open state of the gas valve V1.

In the example shown in FIG. 10, the fitting 3 is provided with the gas valve V1. Alternatively, the container main body 22 of the outer container 2 may be provided with the gas valve, and the fitting 3 may be provided with only a beverage valve. In this case, the first valve seat portion 341 formed in the second mouth portion 34 may function as a valve seat portion of the beverage valve, and the first valve member 37 may function as a valve body of the beverage valve.

In the example shown in FIG. 10, the sealing member 52 is attached to the beverage extraction pipe 45 at a position below the first valve member 37. In this case, an interference between the first valve member 37 and members arranged in the vicinity of the first valve member 37, and the replaceable component 5 including the sealing member 52 is prevented or suppressed. In the example shown in FIG. 10, the sealing member 52 is arranged vertically below the first valve member 37.

In the example shown in FIG. 10, both the first valve member 37 and the sealing member 52 are attached to the beverage extraction pipe 45. More specifically, the first valve member 37 is attached to an upper end portion of the beverage extraction pipe 45, and the sealing member 52 is attached to the outer surface 45*u* (in other words, the outer peripheral surface) of the beverage extraction pipe 45. In this case, when the first valve member 37 moves downward so as to be separated from the first valve seat portion 341, the beverage extraction pipe 45 and the sealing member 52 move downward together with the first valve member 37.

(First Spring 38, First Spring Receiver 39, Outer Cylindrical Portion 40)

In the example shown in FIG. 10, the fitting 3 includes the first spring 38 and the first spring receiver 39 in addition to the first valve member 37. The fitting 3 may include the outer cylindrical portion 40.

The first spring 38 is arranged below the first valve member 37 and biases the first valve member 37 upward. In this case, the gas valve V1 is maintained in the closed state by a biasing force of the first spring 38. On the other hand, the gas valve V1 is opened when the first valve member 37 is pushed downward against the biasing force of the first spring 38. In the example shown in FIG. 10, the first spring 38 is arranged outside the beverage extraction pipe 45 so as to surround the beverage extraction pipe 45.

The first spring receiver 39 is arranged below the first spring 38 and supports the first spring 38. In the example shown in FIG. 10, the first spring receiver 39 is arranged outside the beverage extraction pipe 45 so as to surround the beverage extraction pipe 45.

The outer cylindrical portion 40 is arranged outside the beverage extraction pipe 45. It is preferable that the outer cylindrical portion 40 is provided with a plurality of through hole portions 40*h* that allow the passage of gas. In the example shown in FIG. 10, the first spring 38 is arranged between the outer cylindrical portion 40 and the beverage extraction pipe 45. In this case, the first spring 38 is protected by the outer cylindrical portion 40. An upper end portion of the outer cylindrical portion 40 is fixed (more specifically, welded) to the second mouth portion 34 or the annular portion 36.

In the example shown in FIG. 10, a lower end portion 40*g* of the outer cylindrical portion 40 supports the first spring receiver 39. Alternatively, the lower end portion 40*g* of the outer cylindrical portion 40 may function as the first spring receiver 39.

In the example shown in FIG. 10, the tubular body 55 of the replaceable component 5 is arranged vertically below a structure M3 including the first spring 38, the first spring receiver 39, and the outer cylindrical portion 40 that protects the first spring 38. In this case, the tubular body 55 and the bag 58 before being filled with the beverage can be compactly arranged around the beverage extraction pipe 45 by utilizing a region vertically below the structure M3. Therefore, the replaceable component 5 having the tubular body 55 and the bag 58 can be easily inserted into the outer container 2 via the first mouth portion 27. In this way, the beverage container 1A can be easily assembled. In the example shown in FIG. 10, a tubular portion 551 of the tubular body 55 and the sealing member 52 are arranged in a space inside a virtual cylinder (see the virtual cylinder indicated by a dashed line A) which is formed by virtually extending an outer edge of the outer cylindrical portion 40 downward.

(Second Valve Seat Portion 371 and Second Valve Member 41)

The fitting 3 may have a second valve seat portion 371 and the second valve member 41. A beverage valve V2 is constituted by the second valve seat portion 371 and the second valve member 41. The beverage valve V2 is a valve whose state can be changed between an open state that allows the passage of the beverage and a closed state that prohibits the passage of the beverage.

In the example shown in FIG. 10, the second valve seat portion 371 is formed in the first valve member 37. More specifically, an inner peripheral surface of a lower end portion of the first valve member 37 functions as the second valve seat portion 371. The second valve seat portion 371 is constituted by, for example, an inclined surface whose inner diameter increases in a downward direction.

The second valve member 41 is contactable to the second valve seat portion 371 and is separable from the second valve seat portion 371. A state in which the second valve member 41 is in contact with the second valve seat portion 371 corresponds to the closed state of the beverage valve V2, and a state in which the second valve member 41 is separated from the second valve seat portion 371 corresponds to the open state of the beverage valve V2. In the example shown in FIG. 10, the second valve member 41 is arranged inside the beverage extraction pipe 45. Further, the second valve member 41 can move in the vertical direction in the internal space of the beverage extraction pipe 45.

(Second Spring 42, Second Spring Receiver 454)

In the example shown in FIG. 10, the fitting 3 includes the second spring 42 and the second spring receiver 454 in addition to the second valve member 41.

The second spring 42 is arranged below the second valve member 41 and biases the second valve member 41 upward. In this case, the beverage valve V2 is maintained in the closed state by a biasing force of the second spring 42. On the other hand, the beverage valve V2 is opened when the second valve member 41 is pushed downward against the biasing force of the second spring 42. In the example shown in FIG. 10, the second spring 42 is arranged inside the beverage extraction pipe 45.

The second spring receiver 454 is arranged below the second spring 42 and supports the second spring 42. In the example shown in FIG. 10, the second spring receiver 454 is constituted by a stepped portion (in other words, a portion where an inner diameter changes) of the beverage extraction pipe 45.

In the example shown in FIG. 10, the sealing member 52 of the replaceable component 5 is arranged below the second valve member 41 and above the second spring receiver 454.

(First Mouth Portion 27, and Second Mouth Portion 34)

As shown in FIG. 11, the second mouth portion 34 of the fitting 3 is preferably arranged above the first mouth portion 27 of the outer container 2. In an example shown in FIG. 11, the second mouth portion 34 of the fitting 3 is arranged so as to extend upward from the annular portion 36, and the attachment portion 32 of the fitting 3 is arranged so as to extend downward from the annular portion 36. In this way, the second mouth portion 34 is arranged above the first mouth portion 27 to which the attachment portion 32 is attached.

When the second mouth portion 34 is arranged at a high position, the first valve member 37 that contacts the first valve seat portion 341 of the second mouth portion 34 can be arranged at a higher position. In the example shown in FIG. 11, an upper end surface of the first valve member 37 is arranged at a position higher than the lower end 27*g* of the first mouth portion 27. In addition, the upper end surface of the first valve member 37 is arranged at a position higher than an upper surface 27*e* of the first mouth portion 27.

When the first valve member 37 is arranged at a high position, the sealing member 52 and the tubular body 55 arranged below the first valve member 37 can be arranged at a higher position. Further, when the tubular body 55 is arranged at a high position, a height difference H1 between the lower end 27*g* of the first mouth portion 27 and a attaching position of the bag 58 to the tubular body 55 is reduced. Due to the reduction in the height difference H1, the bag 58 is prevented from being greatly deformed upward due to the increase of the internal pressure of the bag 58.

In the example shown in FIG. 11, an inner diameter D3 of the first mouth portion 27 is remarkably larger than an inner diameter D4 of the annular portion 36. When the inner diameter D3 of the first mouth portion 27 is large, it is easy to insert the replaceable component 5 having the bag 58 into the outer container 2 through the first mouth portion 27. The inner diameter D3 of the first mouth portion 27 is, for example, 6 cm or more and 12 cm or less, or 7 cm or more and 10 cm or less. The inner diameter D3 of the first mouth portion 27 is preferably at least 1.5 times larger, or at least 1.8 times larger than the inner diameter D4 of the annular portion 36. Further, from the viewpoint of allowing the tubular body 55 and the bag 58 attached to the tubular body 55 to be easily inserted into the outer container 2, it is preferable that the inner diameter D3 of the first mouth portion 27 is sufficiently larger than the maximum outer diameter D2 of the tubular body 55 (more specifically, the outer diameter of the first flange 553). The difference between the inner diameter D3 of the first mouth portion 27 and the maximum outer diameter D2 of the tubular body 55 (more specifically, the outer diameter of the first flange 553) is, for example, 15 mm or more, 20 mm or more, or 25 mm or more. In the example shown in FIG. 11, the maximum outer diameter D2 of the tubular body 55 is larger than the inner diameter D4 of the annular portion 36 and smaller than the inner diameter D3 of the first mouth portion 27.

In the example shown in FIG. 11, the first threaded portion 27*s* of the first mouth portion 27 of the outer container 2 is a male threaded portion. Since the first threaded portion 27*s* is a male threaded portion (in other words, an external threaded portion), an inner surface 27*n* of the first mouth portion 27 can be made smooth. In a case in which the inner surface 27*n* of the first mouth portion 27 is a smooth surface, the bag 58 is less likely to get caught on the inner surface 27*n* of the first mouth portion 27, when the replaceable component 5 having the bag 58 is inserted into the outer container 2 through the first mouth portion 27. In this way, the beverage container 1A is easily assembled.

Alternatively, as shown in FIG. 12, the first threaded portion 27*s* of the first mouth portion 27 of the outer container 2 may be a female threaded portion, and the second threaded portion 32*s* of the attachment portion 32 of the fitting 3 may be a male threaded portion.

As shown in FIG. 11, a lower end surface of the first mouth portion 27 may be an inclined surface 27*t* whose inner diameter decreases in an upward direction. The inclined surface 27*t* may be a tapered surface or an R surface (in other words, a convex arcuate surface). Since the lower end surface of the first mouth portion 27 is an inclined surface 27*t* whose inner diameter decreases in an upward direction, the bag 58 is smoothly reduced in diameter by the inclined surface 27*t* when the replaceable component 5 is taken out of the outer container 2. In this way, the bag 58 which is bulky can be smoothly removed from the outer container 2 through the first mouth portion 27.

Figure 25:
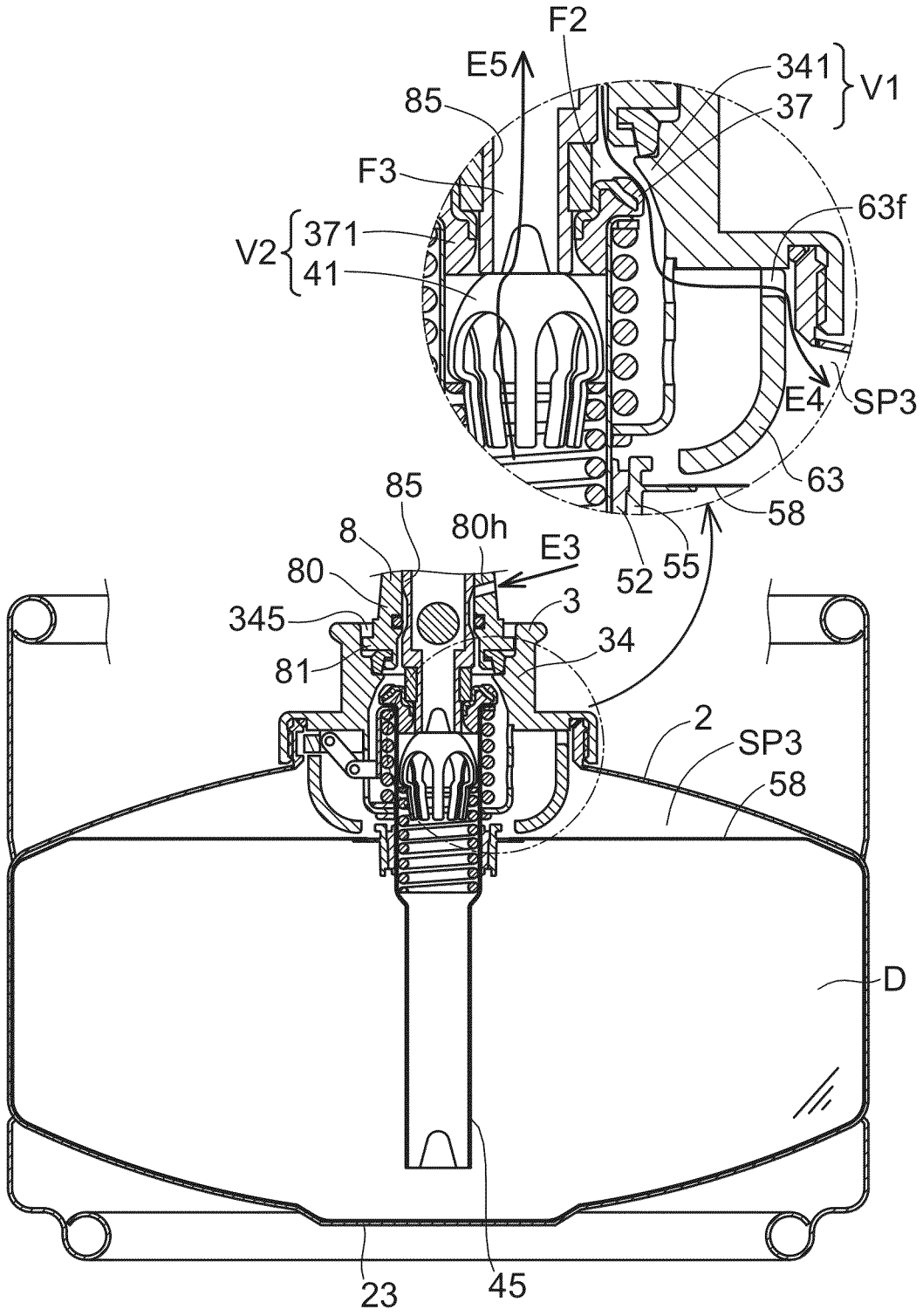
FIG. 25 is a schematic cross-sectional view schematically showing a state in which a beverage extraction step is being executed.

In the example shown in FIG. 11, the second mouth portion 34 of the fitting 3 has a recess portion 347 capable of receiving a lower end of a dispense head main body 80 (see FIG. 25 if necessary). The second mouth portion 34 may have a shoulder portion 348 that positions the lower end of the dispense head main body 80. Further, the second mouth portion 34 may have an annular outward protruding portion 349 at the upper end.

(Sealing Ring 65)

In the example shown in FIG. 11, the beverage container 1A includes a sealing ring 65 arranged between the first mouth portion 27 and the annular portion 36. The sealing ring 65 prevents gas from leaking out from a gap between the outer container 2 and the fitting 3.

In the example shown in FIG. 11, the upper surface 27*e* of the first mouth portion 27 and a lower surface 36*g* of the annular portion 36 are in surface-to-surface contact with each other in a state in which the sealing ring 65 is compressed. Due to the surface-to-surface contact, an amount of compression of the sealing ring 65 is maintained at an appropriate value. In other words, damage to the sealing ring 65 due to excessive compression is prevented, and a stable sealing effect by the sealing ring 65 is maintained.

In the example shown in FIG. 11, the inner portion 36*n* of the annular portion 36 and the outer portion 36*u* of the annular portion 36 are connected via a welded portion 36*w*. In a case in which the inner portion 36*n* and the outer portion 36*u* are manufactured separately, it is easy to form a groove 36*v* (see FIG. 5) for receiving the sealing ring 65 in the lower surface 36*g* of the annular portion 36. The welded portion 36*w* may have any shape as long as the inner portion 36*n* of the annular portion 36 and the outer portion 36*u* of the annular portion 36 can be adequately connected.

(Beverage Extraction Pipe 45)

As shown in FIG. 7, the beverage extraction pipe 45 extends toward the bottom portion 23 of the outer container 2. With the fitting 3 attached to the outer container 2, the lower end 45*g* of the beverage extraction pipe 45 is positioned near the bottom portion 23 of the outer container 2. The distance between the lower end 45*g* of the beverage extraction pipe 45 and an inner surface of the bottom portion 23 of the outer container 2 is, for example, 4 cm or less, 3 cm or less, 2 cm or less, or 1 cm or less. By arranging the lower end 45*g* of the beverage extraction pipe 45 in the vicinity of the bottom portion 23 of the outer container 2, an amount of beverage remaining without being finally extracted from the bag 58 can be reduced. The length of the beverage extraction pipe 45 is, for example, 5 cm or longer, 10 cm or longer, 15 cm or longer, or 20 cm or longer.

In the example shown in FIG. 7, the whole of the beverage extraction pipe 45 and the whole of the replaceable component 5 are arranged in the inner space of the outer container 2. In a state in which the whole of the beverage extraction pipe 45 and the whole of the replaceable component 5 are arranged in the inner space of the outer container 2, the sealing member 52 of the replaceable component 5 may be vertically movable relative to the beverage extraction pipe 45. For example, the sealing member 52 may move upward with respect to the beverage extraction pipe 45 when the bag 58 is expanded by being filled with the beverage.

In the example shown in FIG. 11, the beverage extraction pipe 45 includes a small-diameter pipe portion 45*a* (a first pipe portion), a large-diameter pipe portion 45*c* (a second pipe portion) arranged above the small-diameter pipe portion 45*a*, and a shoulder portion 45*b* (in other words, an outer diameter changing portion) disposed between the small-diameter pipe portion 45*a* and the large-diameter pipe portion 45*c*. The small-diameter pipe portion 45*a* is a pipe portion having an outer diameter smaller than that of the large-diameter pipe portion 45*c*, and the large-diameter pipe portion 45*c* is a pipe portion having an outer diameter larger than that of the small-diameter pipe portion 45*a*.

In the example shown in FIG. 11, the sealing member 52 of the replaceable component 5 is attached to the large-diameter pipe portion 45*c* of the beverage extraction pipe 45. In this case, the outer diameter of the large-diameter pipe portion 45*c* is larger than the minimum inner diameter of the sealing member 52 before being attached to the beverage extraction pipe 45. Due to the elasticity of the sealing member 52, the sealing member 52 attempts to return to its original shape after being attached to an outer peripheral surface of the large-diameter pipe portion 45*c*. Thus, due to the elastic properties of the sealing member 52, the sealing member 52 is stably held by the large-diameter pipe portion 45*c*.

The outer diameter of the small-diameter pipe portion 45*a* is preferably smaller than the minimum inner diameter of the sealing member 52 before being attached to the beverage extraction pipe 45. In this case, when the sealing member 52 is slid along the small-diameter pipe portion 45*a*, no strong frictional force is generated between the sealing member 52 and the small-diameter pipe portion 45*a*. Therefore, the replaceable component 5 having the sealing member 52 can be moved toward the large-diameter pipe portion 45*c* of the beverage extraction pipe 45 more quickly.

(Sealing Member 52 of the Replaceable Component 5)

In an example shown in FIG. 13, the sealing member 52 of the replaceable component 5 has a lower lip portion 522 (see the lower drawing in FIG. 13). The lower lip portion 522 annularly contacts the outer surface 45*u* of the beverage extraction pipe 45. Further, the lower lip portion 522 has a first outer peripheral surface 522*u* to which an internal pressure (hereinafter referred to as "first internal pressure") inside the bag 58 is applied. More specifically, the first outer peripheral surface 522*u* of the lower lip portion 522 is exposed to a space SP2 inside the bag 58. In this case, when the first internal pressure inside the bag 58 increases, a force with which the lower lip portion 522 is pushed toward the beverage extraction pipe 45 increases. As a result, it is effectively prevented that the fluid (gas or beverage) in the bag 58 leaks from between the sealing member 52 and the beverage extraction pipe 45.

As shown in the upper diagram of FIG. 13, before the sealing member 52 is attached to the beverage extraction pipe 45, the lower lip portion 522 preferably has an inner surface 522*n* that inclines inward in a downward direction.

In the example shown in FIG. 13, the sealing member 52 of the replaceable component 5 has an upper lip portion 526 (see the lower drawing in FIG. 13). The upper lip portion 526 annularly contacts the outer surface 45*u* of the beverage extraction pipe 45. Further, the upper lip portion 526 has a second outer peripheral surface 526*u* to which an internal pressure (hereinafter referred to as "second internal pressure") inside the outer container 2 is applied. More specifically, the second outer peripheral surface 526*u* of the upper lip portion 526 is exposed to a space inside the outer container 2 (more specifically, a space SP3 between the outer container 2 and the bag 58). In this case, when the pressure in the space SP3 between the outer container 2 and the bag 58 (in other words, the second internal pressure) increases, a force with which the upper lip portion 526 is pushed toward the beverage extraction pipe 45 increases. As a result, it is effectively prevented that the gas in the space SP3 between the outer container 2 and the bag 58 enters the bag 58 from between the sealing member 52 and the beverage extraction pipe 45.

As shown in the upper diagram of FIG. 13, in a state before the sealing member 52 is attached to the beverage extraction pipe 45, the upper lip portion 526 preferably has an inner surface 526*n* that inclines inward in an upward direction.

In the example shown in FIG. 13, an annular protruding portion 524 is formed in the inner surface of the sealing member 52 of the replaceable component 5 (see the upper diagram in FIG. 13). The annular protruding portion 524 is positioned between the beverage extraction pipe 45 and the tubular body 55 in a state in which the sealing member 52 is attached to the beverage extraction pipe 45. The beverage extraction pipe 45 stably supports the replaceable component 5 via the annular protruding portion 524 that is compressed between the beverage extraction pipe 45 and the tubular body 55 (see the lower diagram in FIG. 13).

In the example shown in FIG. 13, the annular protruding portion 524 is arranged between the lower lip portion 522 and the upper lip portion 526. In this case, multiple seals are ensured between the beverage extraction pipe 45 and the sealing member 52. For example, even if a sealing failure occurs in at least one of the lower lip portion 522 and the upper lip portion 526, fluid will not leak from the gap between the beverage extraction pipe 45 and the sealing member 52.

In the example shown in FIG. 13, the sealing member 52 has a tubular shape as a whole. A length L1 of the sealing member 52 in a direction parallel to the longitudinal direction of the beverage extraction pipe 45 is, for example, 8 mm or more. Also, the length L1 of the sealing member 52 is, for example, 30 mm or less. When the length L1 of the sealing member 52 is long, the sealing member 52 is stably held by the beverage extraction pipe 45. Further, when the length L1 of the sealing member 52 is long, the fluid is less likely to leak from the gap between the beverage extraction pipe 45 and the sealing member 52. A length L2 of a contact surface between the sealing member 52 and the tubular body 55 in the direction parallel to the longitudinal direction of the beverage extraction pipe 45 is, for example, 6 mm or more. Also, the length L2 of the contact surface is, for example, 28 mm or less. Since the length L2 of the contact surface is long, separation of the sealing member 52 from the tubular body 55 is effectively prevented. It is preferable that the sealing member 52 is firmly fixed to the tubular body 55.

(Tubular Body 55)

The tubular body 55 is arranged outside the sealing member 52 and holds the sealing member. The elastic modulus of the tubular body 55 is higher than that of the sealing member 52. It is preferable that the tubular body 55 is constituted by an inflexible member (in other words, a member whose substantial deformation is suppressed). The tubular body 55 is made of, for example, synthetic resin such as polyethylene or polypropylene. The tubular body 55 and the sealing member 52 are, for example, integrally formed within a mold. Alternatively, the tubular body 55 and the sealing member 52 may be molded separately, and then the sealing member 52 may be attached to the tubular body 55.

In the example shown in FIG. 13, in a state in which the sealing member 52 is attached to the beverage extraction pipe 45, the tubular body 55 is maintained in a non-contact state with the beverage extraction pipe 45 (see the lower diagram in FIG. 13). In other words, of the tubular body 55 and the sealing member 52, only the sealing member 52 is in contact with the beverage extraction pipe 45. In this case, the sealing effect of the sealing member 52 is maximized.

As shown in FIG. 13, a lower end portion 55*g* of the tubular body 55 may partially or entirely cover the lower lip portion 522 via a gap G1. In this case, part or all of the lower lip portion 522 is protected by the lower end portion 55*g* of the tubular body 55, and unintended damage to the lower lip portion 522 is prevented or suppressed. An upper end portion 55*e* of the tubular body 55 may partially or entirely cover the upper lip portion 526 via a gap G2. In this case, part or all of the upper lip portion 526 is protected by the upper end portion 55*e* of the tubular body 55, and unintended damage to the upper lip portion 526 is prevented or suppressed.

In the example shown in FIG. 13, the tubular body 55 has the tubular portion 551 and the first flange 553. Additionally, the tubular body 55 may have a second flange 555 and an annular groove 557.

The tubular portion 551 is a portion that holds the sealing member 52. The tubular portion 551 holds the sealing member 52 and prevents excessive deformation of the sealing member 52. The tubular portion 551 extends in a direction parallel to the longitudinal direction of the beverage extraction pipe 45. The length of the tubular portion 551 in the direction parallel to the longitudinal direction of the beverage extraction pipe 45 may be longer than the length L1 of the sealing member 52, may be shorter than the length L1 of the sealing member 52, or may be substantially the same as the length L1 of the sealing member 52.

The first flange 553 functions as an attached portion (more specifically, a weld portion) to which the bag 58 is attached. Welding between the first flange 553 and the bag 58 is, for example, high frequency welding. Alternatively, welding between the first flange 553 and the bag 58 may be heat welding or ultrasonic welding. In the example shown in FIG.

13, the bag 58 is welded to an upper surface of the first flange 553. Alternatively, the bag 58 may be welded to a lower surface of the first flange 553. The first flange 553 has an inner edge connected to the tubular portion 551 and an outer edge that is a free edge.

The second flange 555 is arranged above the first flange 553. In the example shown in FIG. 13, an outer diameter of the second flange 555 is smaller than an outer diameter of the first flange 553. In this case, when the bag 58 is attached to the first flange 553, the second flange 555 is unlikely to be an obstacle. The second flange 555 has an inner edge connected to the tubular portion 551 and an outer edge that is a free edge.

The annular groove 557 is arranged between the first flange 553 and the second flange 555.

The second flange 555 and/or the annular groove 557 is a portion that is held or gripped by a machine or jig. The presence of the second flange 555 (or the annular groove 557) makes the manufacturing of the replaceable component 5 and/or the transportation of the replaceable component 5 easy.

(Bag 58)

The bag 58 is attached to the tubular body 55. In an example shown in FIG. 14, a mouth portion 58*c* (a portion indicated by hatching) of the bag 58 is attached to the first flange 553 of the tubular body 55. The bag 58 is arranged in the inner space of the outer container 2 while attached to the tubular body 55. The beverage is contained in the bag 58. The bag 58 can be filled with the beverage, and the beverage can be taken out of the bag 58.

The bag 58 is made of, for example, synthetic resin such as polyethylene or polypropylene. The bag 58 may be composed of any one of a high-density polyethylene layer, a low-density polyethylene layer, a polyethylene terephthalate layer, and a nylon layer, or may be composed of a laminate of these layers. Further, the bag 58 may be constituted by a laminated film in which a light-shielding layer or an oxygen barrier layer such as an aluminum foil or an aluminum vapor deposition layer is placed between a plurality of synthetic resin layers in order to ensure light-shielding property and/or oxygen barrier property. Further, the bag 58 may be constituted by a laminated film in which an oxygen barrier layer such as an ethylene vinyl alcohol copolymer is placed between a plurality of synthetic resin layers. The bag 58 may be constituted by a laminated film including a nylon layer, a polyethylene layer, and an aluminum layer. Note that, the material of the bag 58 is not limited to the above-mentioned examples.

(Removal-Preventing Member 46)

In an example shown in FIG. 15, the fitting 3 has a removal-preventing member 46 that prevents the fitting 3 from being removed from the outer container 2. The removal-preventing member 46 has an engaging member 47 that can engage with the outer container 2 (more specifically, an inner surface of the first mouth portion 27 of the outer container 2).

The engaging member 47 is repositionable between an engaging position Q1 in which the engaging member engages with the outer container 2 (more specifically, an engaging portion 28 of the outer container 2), and a retracted position Q2 (see FIG. 16) in which the engaging member is retracted from the outer container 2 (more specifically, the engaging portion 28 of the outer container 2). The fitting 3 cannot be removed from the outer container 2 when the engaging member 47 is in the engaging position Q1. On the other hand, the fitting 3 can be removed from the outer container 2 when the engaging member 47 is in the retracted position Q2.

In the example shown in FIGS. 15 and 16, the engagement between the outer container 2 and the engaging member 47 is released by pushing the first valve member 37 downward. More specifically, when the first valve member 37 is pushed downward, the engaging member 47 moves from the engaging position Q1 to the retracted position Q2. Further, when the downward force to the first valve member 37 is released, the engaging member 47 moves from the retracted position Q2 to the engaging position Q1. In this case, the fitting 3 cannot be removed from the outer container 2 unless the first valve member 37 is pushed downward. Therefore, the fitting 3 is prevented from being removed from the outer container 2 without using a special removal tool (more specifically, an instrument capable of rotating the fitting 3 around the central axis C1 while pushing the first valve member 37 downward).

The removal-preventing member 46 preferably has a conversion mechanism (for example, a link arm 49*a* or a cam surface such as an inclined surface) that converts downward movement of the first valve member 37 into movement of the engaging member 47. Moreover, the fitting 3 preferably has a biasing member that biases the engaging member 47 in a direction from the retracted position Q2 toward the engaging position Q1. In the example shown in FIG. 15, the first spring 38 that biases the first valve member 37 upward functions as the biasing member that biases the engaging member 47 in the direction from the retracted position Q2 toward the engaging position Q1.

In the example shown in FIG. 15, the removal-preventing member 46 includes a first movable member 48 that can move downward together with the first valve member 37 and a second movable member 49 that converts downward movement of the first movable member 48 into movement of the engaging member 47. More specifically, the second movable member 49 converts downward movement of the first movable member 48 into movement of the engaging member 47 in a direction away from the engaging portion 28 of the outer container 2 (or, movement of the engaging member 47 in a direction toward the central axis C2 of the beverage extraction pipe 45). In the example shown in FIG. 15, the second movable member 49 is the link arm 49*a*.

In the example shown in FIG. 15, one end of the first movable member 48 is connected to the beverage extraction pipe 45 and the other end of the first movable member 48 is connected to the second movable member 49. The first movable member 48 is vertically movable relative to the outer cylindrical portion 40.

In the example shown in FIG. 15, one end of the second movable member 49 is swingably connected to the first movable member 48, and the other end of the second movable member 49 is swingably connected to the engaging member 47.

Further, in the example shown in FIG. 15, the tip of the engaging member 47 can engage with the engaging portion 28 (for example, engaging recess) formed in the first mouth portion 27 of the outer container 2.

In the example shown in FIG. 15, the spacer member 63 is arranged to prevent the bag 58 from coming into direct contact with the removal-preventing member 46. A portion of the removal-preventing member 46 (for example, the engaging member 47) may be arranged across the spacer member 63. A portion of the removal-preventing member 46 (for example, the first movable member 48) may be arranged across the through hole portion 40*h* of the outer cylindrical portion 40 of the fitting 3.

(First Modified Example of the Removal-Preventing Member 46)

In an example shown in FIG. 17, the removal-preventing member 46 includes the first movable member 48 that can move downward together with the first valve member 37 and the second movable member 49 that converts downward movement of the first movable member 48 into movement of the engaging member 47. More specifically, the second movable member 49 converts downward movement of the first movable member 48 into movement of the engaging member 47 in a direction away from the engaging portion 28 of the outer container 2.

In the example shown in FIG. 17, one end of the first movable member 48 is connected to the beverage extraction pipe 45 and the other end of the first movable member 48 is connected to the second movable member 49. The first movable member 48 is vertically movable relative to the outer cylindrical portion 40.

In the example shown in FIG. 17, the second movable member 49 is vertically movable together with the first movable member 48. The second movable member 49 has a first cam surface 49*c* (more specifically, a first inclined surface).

In the example shown in FIG. 17, the engaging member 47 has a second cam surface 47*c* (more specifically, a second inclined surface) that contacts the first cam surface 49*c*. Further, the tip of the engaging member 47 can engage with the engaging portion 28 (for example, engaging recess) formed in the first mouth portion 27 of the outer container 2.

In the example shown in FIG. 17, the fitting 3 has a biasing member (38) that biases the engaging member 47 in a direction from the retracted position Q2 toward the engaging position Q1. In addition, in the example shown in FIG. 17, the fitting 3 has a second biasing member 44 that biases the engaging member 47 in a direction from the engaging position Q1 toward the retracted position Q2. A biasing force of the biasing member (38) is greater than a biasing force of the second biasing member 44.

(Second Modified Example of the Removal-Preventing Member 46)

As shown in FIG. 17, in a first modified example of the removal-preventing member 46, the second biasing member 44 is a leaf spring. Alternatively, as shown in FIG. 18, the second biasing member 44 that biases the engaging member 47 in the direction from the engaging position Q1 toward the retracted position Q2 may be a coil spring.

Second Embodiment

Figure 19:
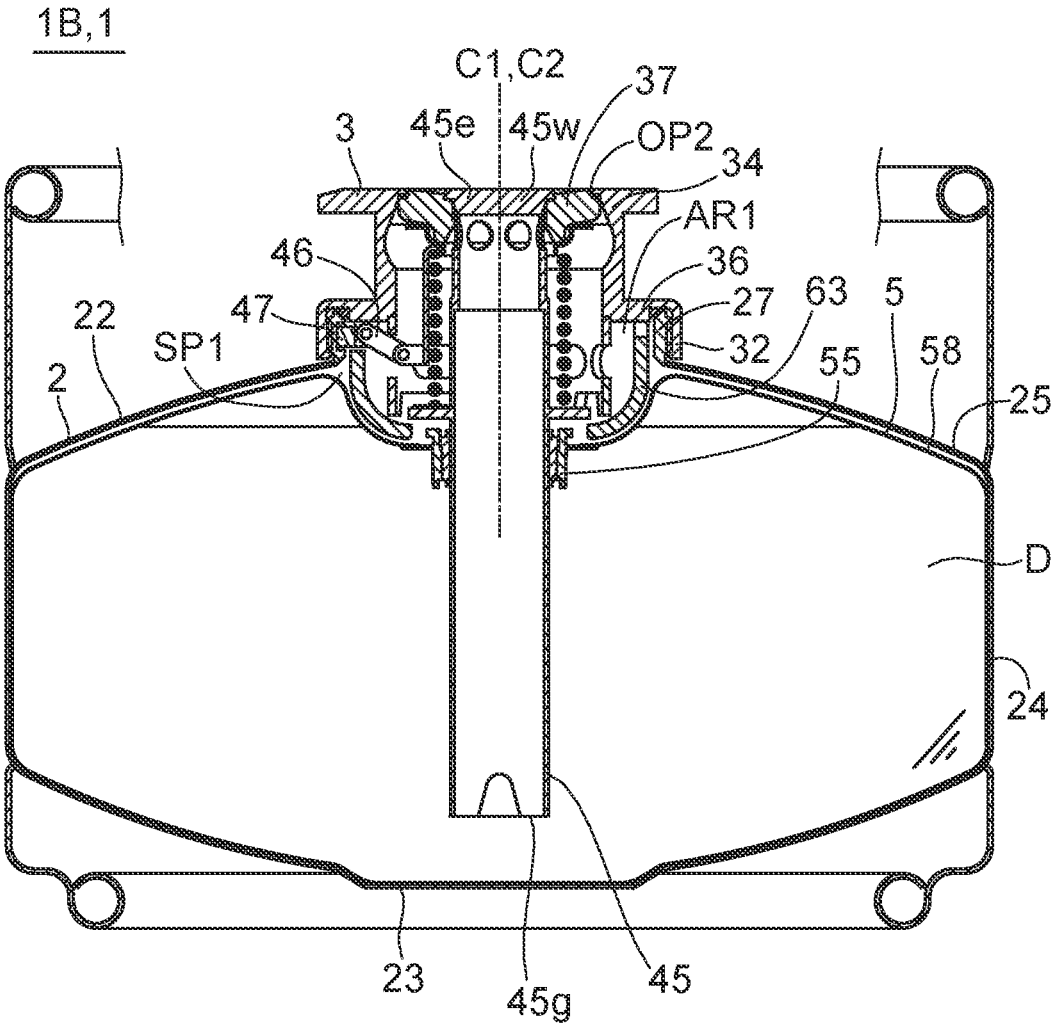
FIG. 19 is a schematic cross-sectional view schematically showing a beverage container according to a second embodiment.
Figure 20:
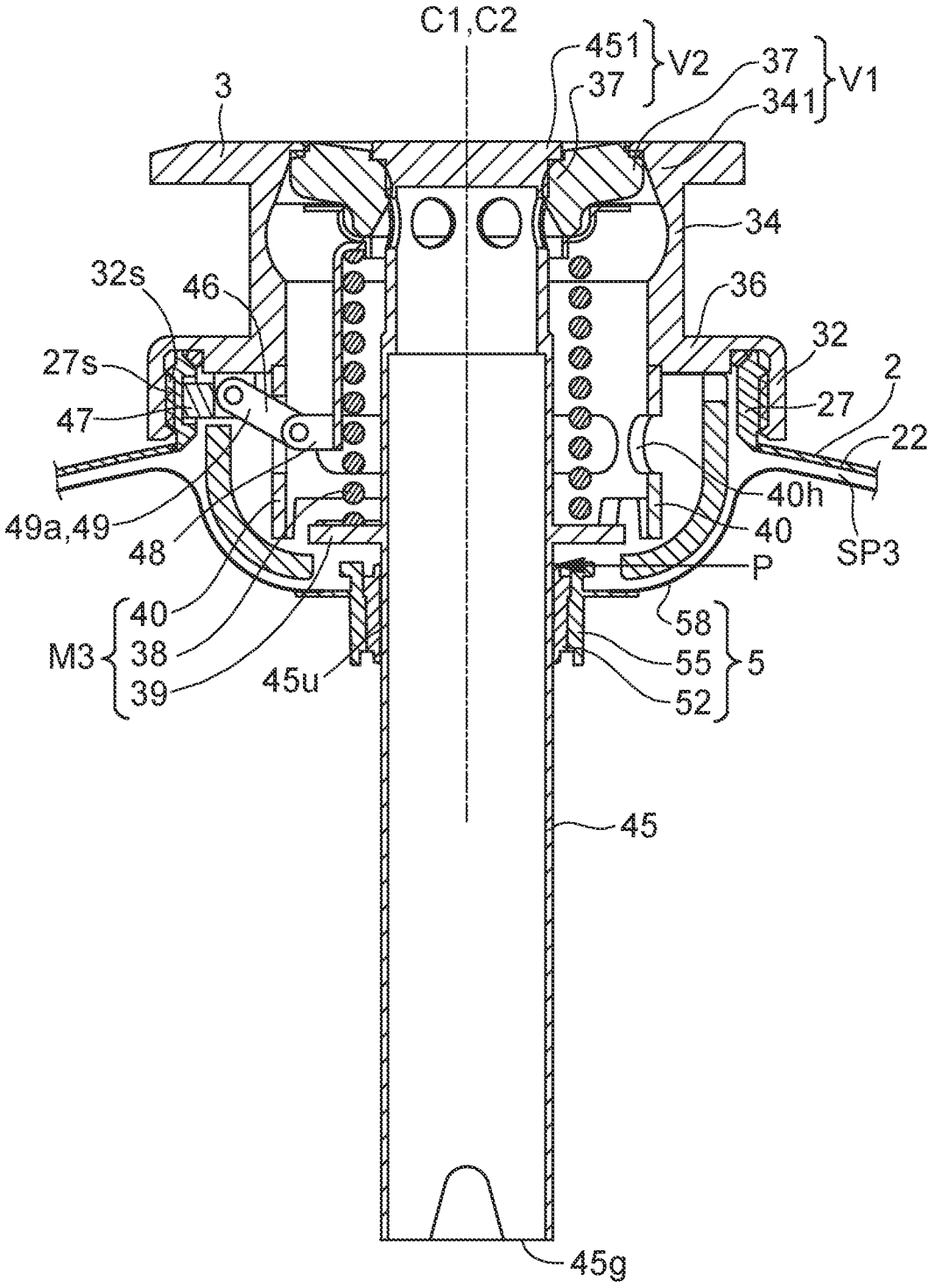
FIG. 20 is a schematic cross-sectional view schematically showing a part of the beverage container according to the second embodiment.

A beverage container 1B according to the second embodiment will be described with reference to FIGS. 19 and 20. FIG. 19 is a schematic cross-sectional view schematically showing a beverage container 1B according to the second embodiment. FIG. 20 is a schematic cross-sectional view schematically showing a part of the beverage container 1B according to the second embodiment.

A beverage container 1B according to the second embodiment differs from the beverage container 1A according to the first embodiment in a shape of a top portion of the fitting 3. More specifically, the beverage container 1A according to the first embodiment has a well-type fitting in which a top portion shape of the fitting 3 is a concave shape, whereas the beverage container 1B according to the second embodiment has a flat-type fitting in which a top portion shape of the fitting 3 is a flat shape.

The flat-type fitting 3 will be additionally explained. In an example shown in FIG. 19, an annular second opening OP2 is formed between a top portion of the second mouth portion 34 and a top wall 45*w* of the beverage extraction pipe 45, and the annular second opening OP2 is opened and closed by the first valve member 37. When the first valve member 37 is in an upper position (in other words, when the first valve member 37 closes the annular second opening OP2), the top portion shape of the fitting 3 is substantially the flat shape. More specifically, a top surface of the second mouth portion 34, a top surface of the first valve member 37, and a top surface of the beverage extraction pipe 45 are arranged at approximately the same height. Therefore, it can be said that the fitting 3 shown in FIG. 19 is of a flat type.

In the second embodiment, differences from the first embodiment will be mainly described, and repetitive description of the matters explained in the first embodiment will be omitted. Therefore, it goes without saying that the matters explained in the first embodiment can be adopted in the second embodiment even if they are not explicitly explained in the second embodiment.

As shown in FIG. 20, the beverage container 1B according to the second embodiment includes, (1) an outer container 2 having a first mouth portion 27, (2) a fitting 3 having a beverage extraction pipe 45, and (3) a replaceable component 5 attached to the beverage extraction pipe 45 and arranged in an inner space of the outer container 2. The fitting 3 includes, (2*a*) an attachment portion 32 attached to the first mouth portion 27 of the outer container 2, (2*b*) a second mouth portion 34 connectable to a beverage filling nozzle or a dispense head, (2*c*) an annular portion 36 extending outward from the second mouth portion 34 and connecting the second mouth portion 34 and the attachment portion 32, and (2*d*) the beverage extraction pipe 45 extending toward a bottom of the outer container 2. Moreover, the replaceable component 5 includes, (3*a*) a sealing member 52 slidable along a longitudinal direction of the beverage extraction pipe 45 and being in annular contact with an outer surface 45*u* of the beverage extraction pipe 45 at an installation position P, (3*b*) a tubular body 55 holding the sealing member 52 and being supported by the beverage extraction pipe 45 via the sealing member 52 located at the installation position P, and (3*c*) a bag 58 for containing a beverage attached to the tubular body 55.

Therefore, the second embodiment has the same effect as the first embodiment.

(Outer Container 2)

The outer container 2 has a container main body 22 and the first mouth portion 27. Since the container main body 22 and the first mouth portion 27 have already been described in the first embodiment, repeated description of these parts will be omitted.

(Fitting 3)

The fitting 3 includes the attachment portion 32, the second mouth portion 34, the annular portion 36 and the beverage extraction pipe 45. Since the attachment portion 32, the second mouth portion 34, the annular portion 36, and the beverage extraction pipe 45 have already been described in the first embodiment, repeated description of these portions or members will be omitted.

(Replaceable Component 5)

The replaceable component 5 includes the sealing member 52, the tubular body 55 and the bag 58. Since the sealing member 52, the tubular body 55, and the bag 58 have already been described in the first embodiment, repeated description of these portions or members will be omitted.

(Gas Valve V1 and Beverage Valve V2)

In an example shown in FIG. 20, the fitting 3 includes a gas valve V1 that can change its state between an open state that allows the passage of gas and a closed state that prohibits the passage of gas, and a beverage valve V2 that can change its state between an open state that allows the passage of beverage and a closed state that prohibits the passage of beverage.

The fitting 3 has a first valve member 37. The first valve member 37 functions as a valve body of the gas valve V1 and functions as a valve body of the beverage valve V2. The first valve member 37 is movable relative to both the second mouth portion 34 and the beverage extraction pipe 45.

In the example shown in FIG. 20, the gas valve V1 includes the first valve member 37 and a first valve seat portion 341 formed in the second mouth portion 34. A state in which the first valve member 37 is in contact with the first valve seat portion 341 corresponds to the closed state of the gas valve V1, and a state in which the first valve member 37 is separated from the first valve seat portion 341 corresponds to the open state of the gas valve V1. Further, the beverage valve V2 includes the first valve member 37 and a second valve seat portion 451 formed in the beverage extraction pipe 45. A state in which the first valve member 37 is in contact with the second valve seat portion 451 corresponds to the closed state of the beverage valve V2, and a state in which the first valve member 37 is separated from the second valve seat portion 451 corresponds to the open state of the beverage valve V2.

In the example shown in FIG. 20, since the first valve member 37 functions as the valve body of the gas valve V1 and the valve body of the beverage valve V2, the second valve member 41 (see FIG. 10 if necessary) is omitted.

Next, with reference to FIGS. 19 and 20, optional configurations that can be adopted in the second embodiment will be described.

(Spacer Member 63)

In the example shown in FIG. 19, the beverage container 1B includes a spacer member 63 arranged between the annular portion 36 and the tubular body 55. Since the spacer member 63 has already been described in the first embodiment, repeated description of the spacer member 63 will be omitted.

(First Valve Member 37, First Spring 38, First Spring Receiver 39, Outer Cylindrical Portion 40)

In the example shown in FIG. 20, the fitting 3 includes a first spring 38 and a first spring receiver 39 in addition to the first valve member 37. The fitting 3 may have an outer cylindrical portion 40.

The first spring 38 is arranged below the first valve member 37 and biases the first valve member 37 upward. In this case, the gas valve V1 and the beverage valve V2 are maintained in the closed state by a biasing force of the first spring 38. On the other hand, the gas valve V1 and the beverage valve V2 are opened when the first valve member 37 is pushed downward against the biasing force of the first spring 38. In the example shown in FIG. 20, the first spring 38 is arranged outside the beverage extraction pipe 45 so as to surround the beverage extraction pipe 45.

The first spring receiver 39 is arranged below the first spring 38 and supports the first spring 38. In the example shown in FIG. 20, the first spring receiver 39 is attached to the outer surface of the beverage extraction pipe 45 so as to surround the beverage extraction pipe 45.

The outer cylindrical portion 40 is arranged outside the beverage extraction pipe 45. It is preferable that the outer cylindrical portion 40 is provided with a plurality of through hole portions 40*h* that allow the passage of gas. In the example shown in FIG. 20, the first spring 38 is arranged between the outer cylindrical portion 40 and the beverage extraction pipe 45. In this case, the first spring 38 is protected by the outer cylindrical portion 40. In the example shown in FIG. 20, an upper end portion of the outer cylindrical portion 40 is fixed (more specifically, welded) to the second mouth portion 34 or the annular portion 36.

In the example shown in FIG. 20, the tubular body 55 of the replaceable component 5 is arranged vertically below a structure M3 including the first spring 38, the first spring receiver 39, and the outer cylindrical portion 40 that protects the first spring 38. In this case, the tubular body 55 and the bag 58 before being filled with the beverage can be compactly arranged around the beverage extraction pipe 45 by utilizing a region vertically below the structure M3.

(Removal-Preventing Member 46)

In the example shown in FIG. 20, the beverage container 1B includes a removal-preventing member 46 that prevents the fitting 3 from being removed from the outer container 2. Since the removal-preventing member 46 has already been described in the first embodiment, repeated description of the removal-preventing member 46 will be omitted.

(Method of Assembling a Beverage Container and Method of Handling a Beverage Container)

Figure 21:
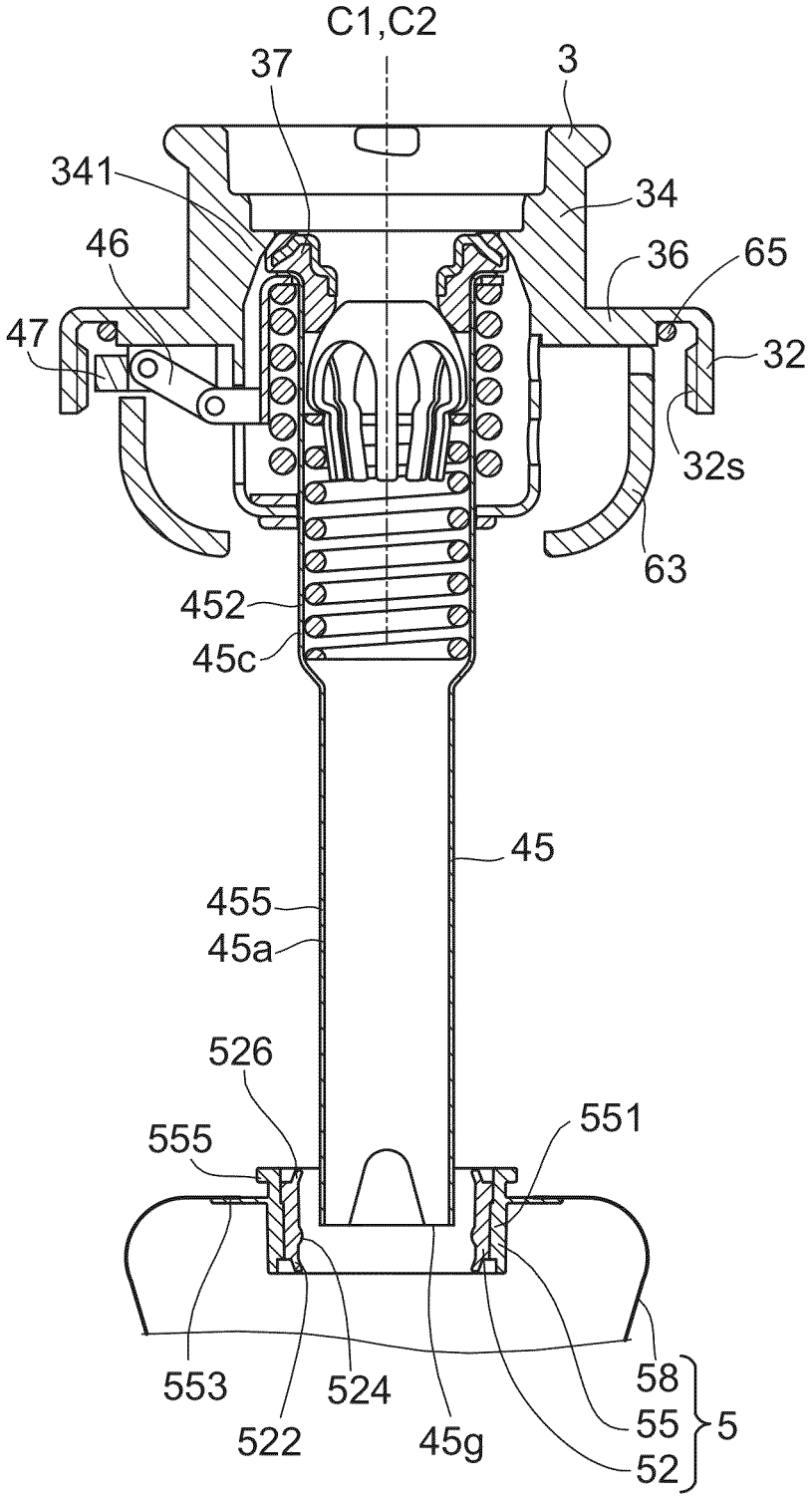
FIG. 21 is a schematic cross-sectional view schematically showing a state in which a first attaching step is being executed.
Figure 22:
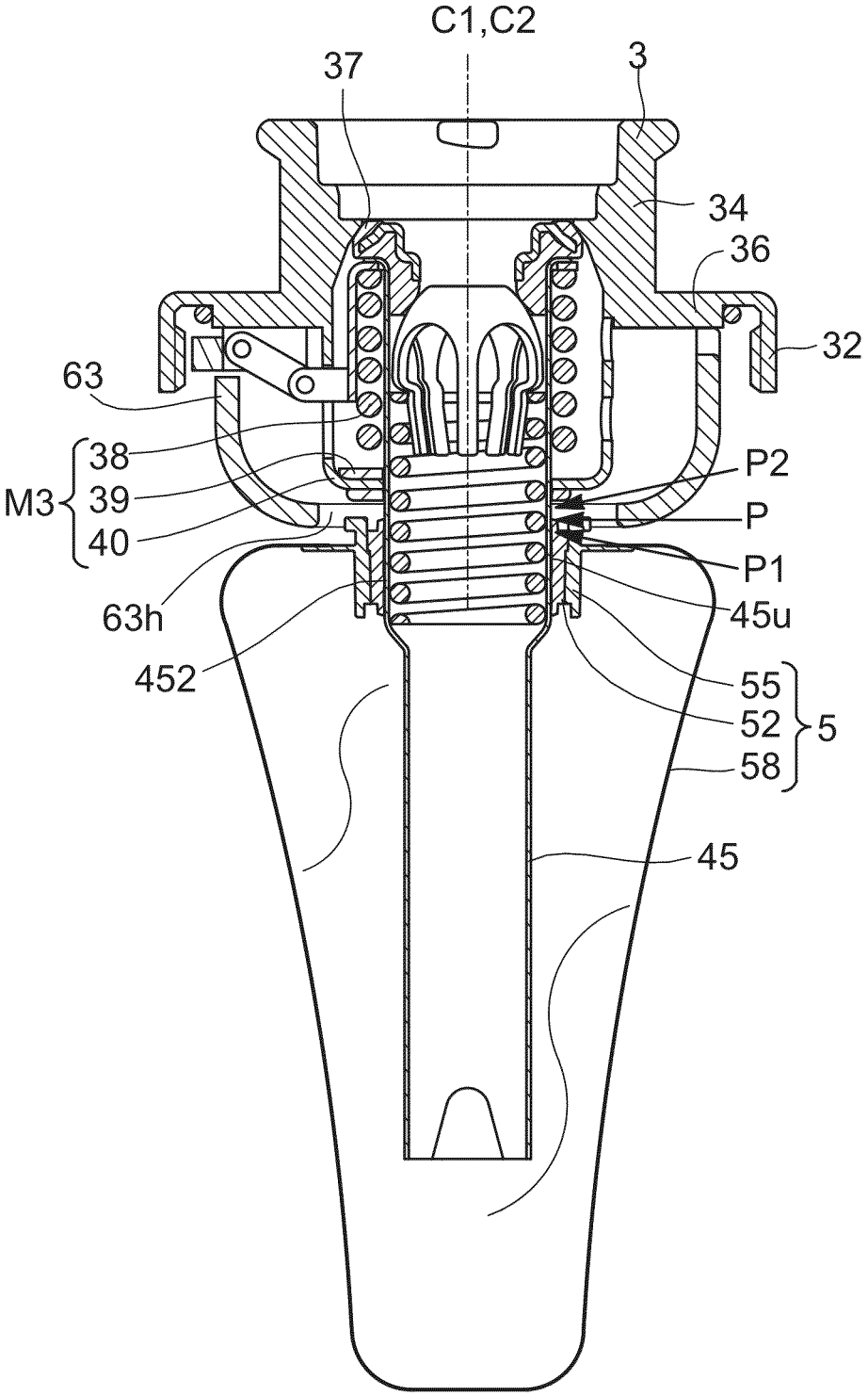
FIG. 22 is a schematic cross-sectional view schematically showing a state after a replaceable component is attached to a beverage extraction pipe.
Figure 23:
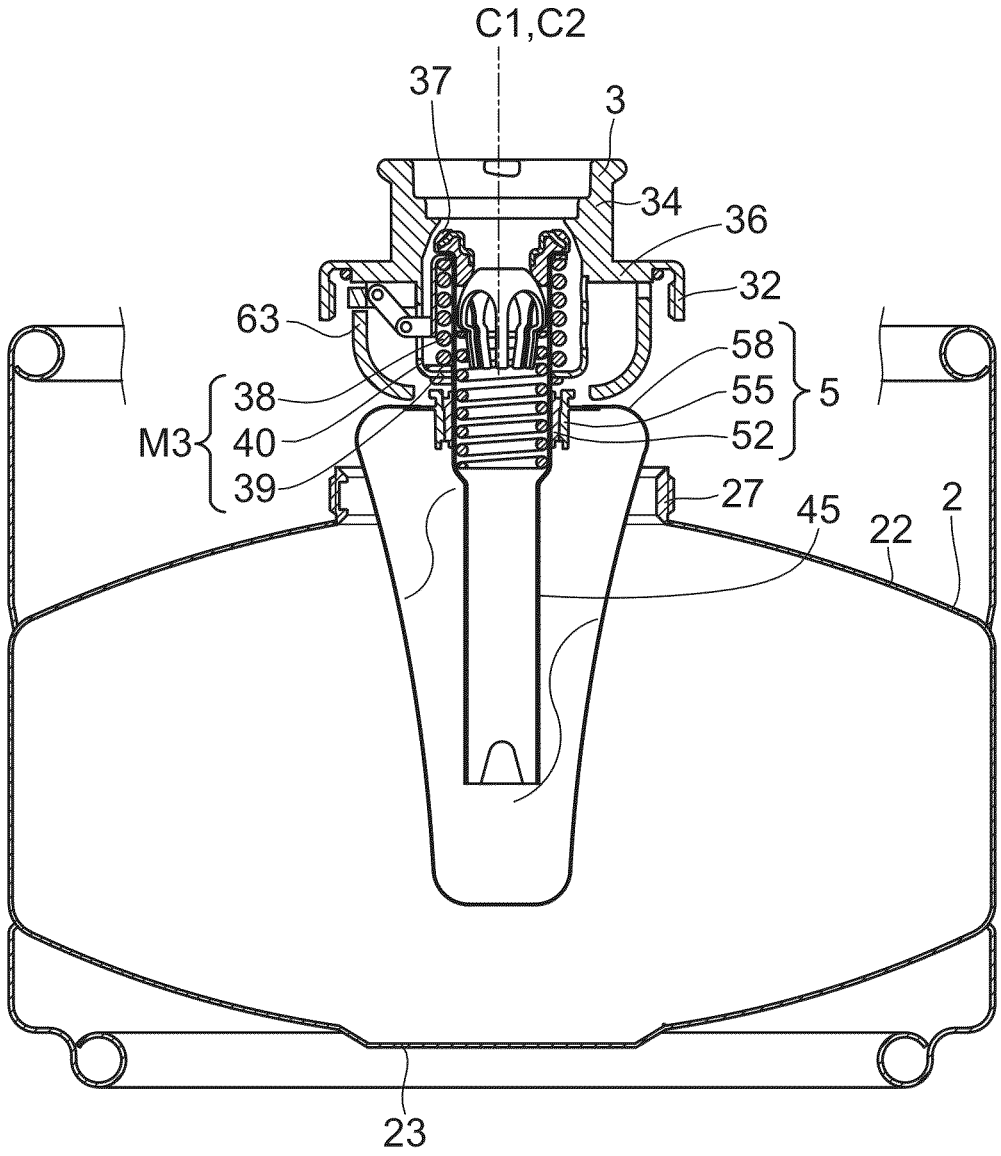
FIG. 23 is a schematic cross-sectional view schematically showing a state in which an inserting step is being executed.
Figure 24:
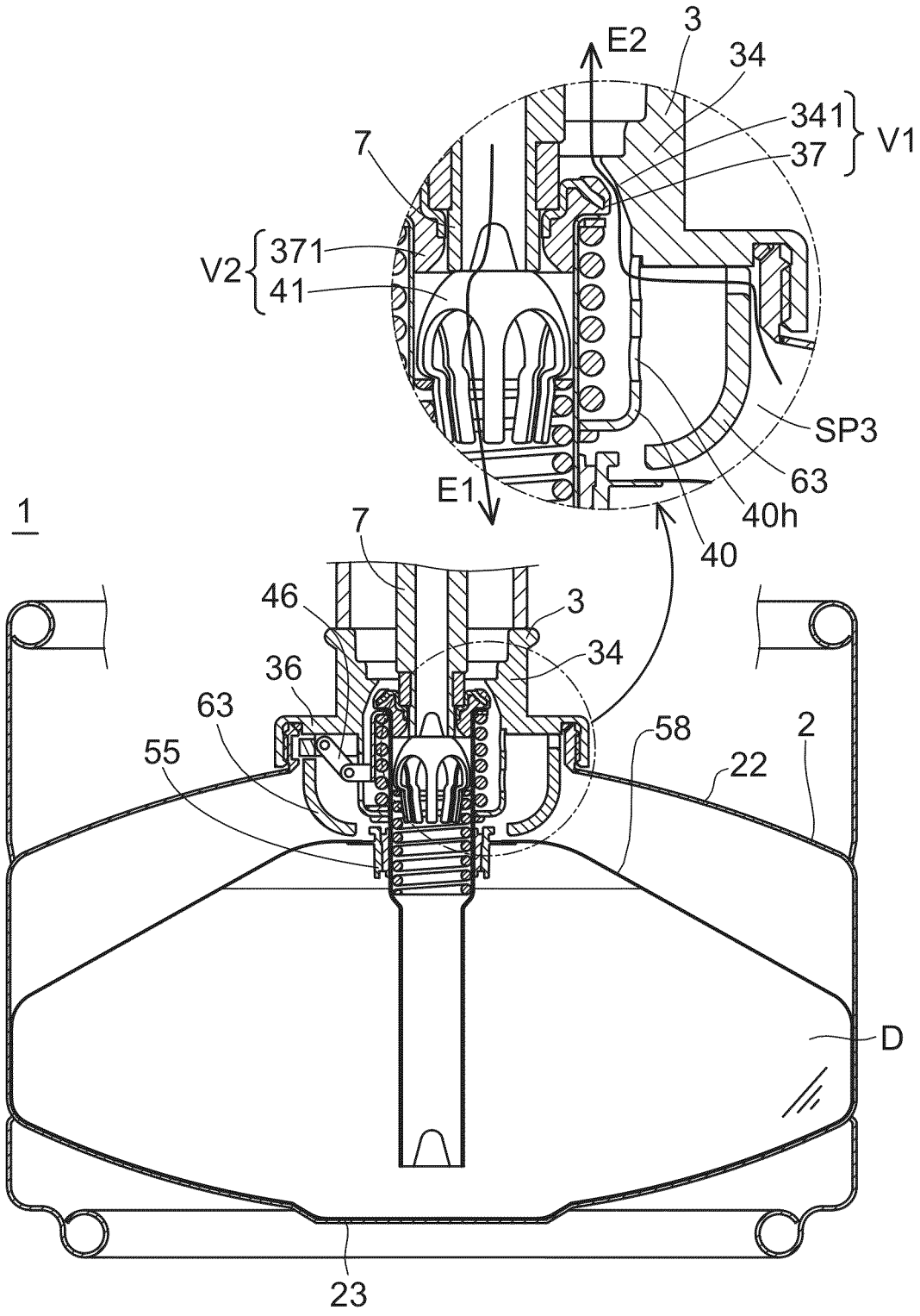
FIG. 24 is a schematic cross-sectional view schematically showing a state in which a beverage filling step is being executed.
Figure 26:
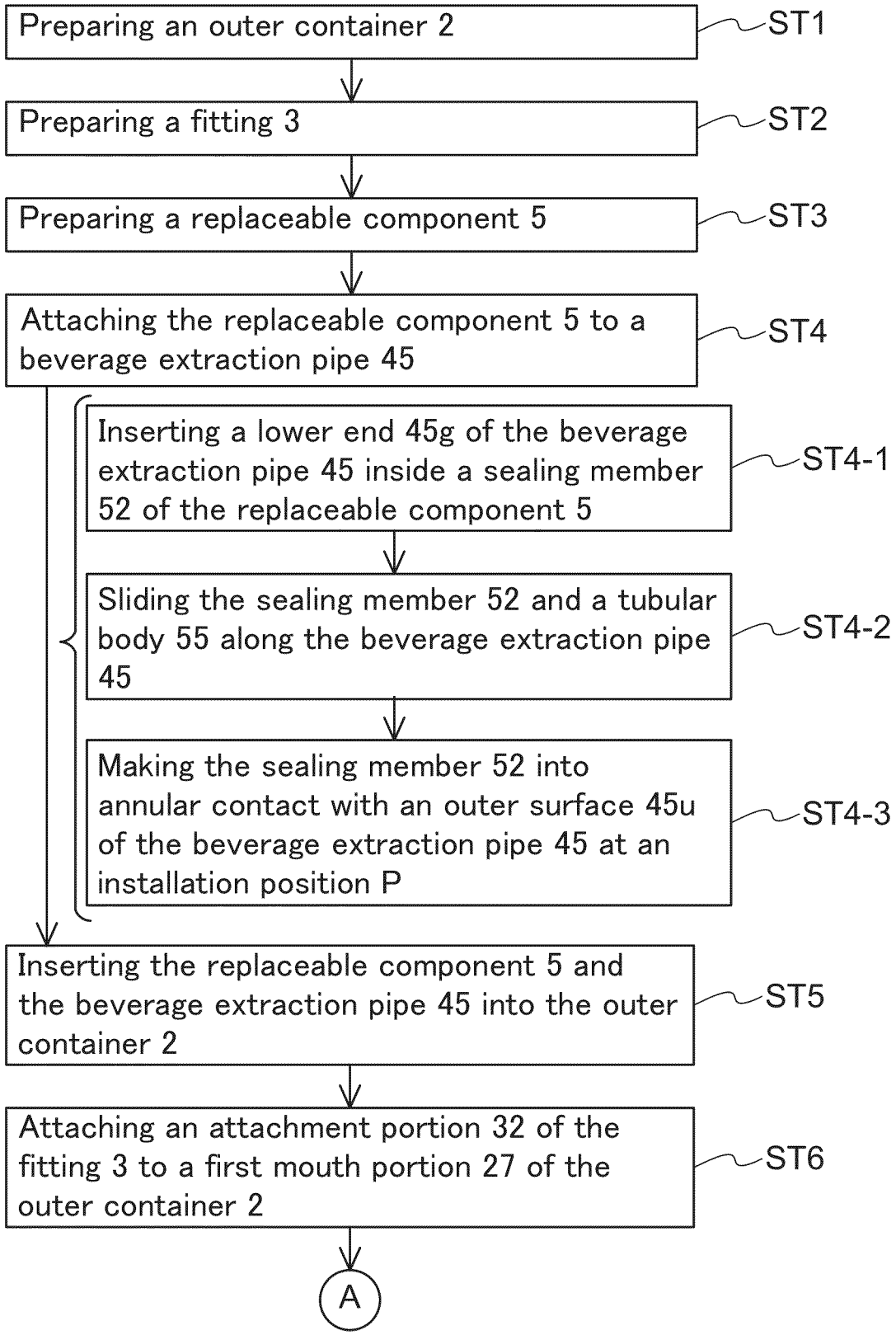
FIG. 26 is a flowchart showing an example of a method of assembling a beverage container.
Figure 27:
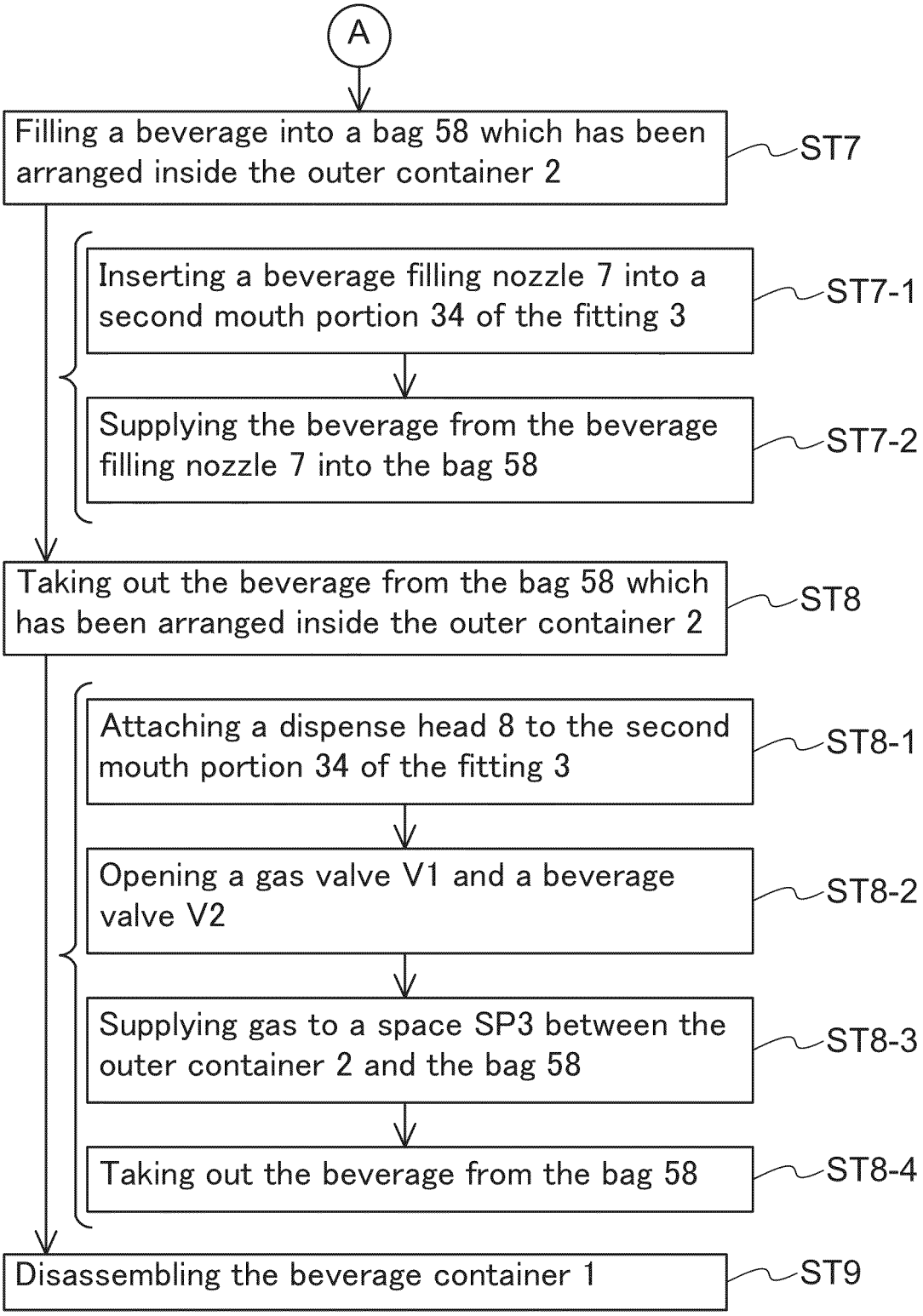
FIG. 27 is a flowchart showing an example of a method of handling a beverage container.

With reference to FIGS. 1 to 27 a method of assembling a beverage container 1 and a method of handling a beverage container 1 according to some embodiments will be described. FIG. 21 is a schematic cross-sectional view schematically showing a state in which a first attaching step is being executed. FIG. 22 is a schematic cross-sectional view schematically showing a state after a replaceable component 5 is attached to a beverage extraction pipe 45. FIG. 23 is a schematic cross-sectional view schematically showing a state in which an inserting step is being executed. FIG. 24 is a schematic cross-sectional view schematically showing a state in which a beverage filling step is being executed. FIG. 25 is a schematic cross-sectional view schematically showing a state in which a beverage extraction step is being executed. FIG. 26 is a flowchart showing an example of a method of assembling a beverage container. FIG. 27 is a flowchart showing an example of a method of handling a beverage container.

A method of assembling a beverage container according to some embodiments constitutes a part of a method of handling a beverage container according to some embodiments. A beverage container 1 assembled using the method of assembling a beverage container according to some embodiments may be the beverage container 1A according to the first embodiment, may be the beverage container 1B according to the second embodiment, or may be another beverage container. Since each component of the beverage container 1 has already been described in the first embodiment or the second embodiment, repeated description of each component of the beverage container 1 will be omitted.

In a first step ST1, an outer container 2 having a container main body 22 and a first mouth portion 27 is prepared. The first step ST1 is a first preparing step. The outer container 2 prepared in the first preparing step is preferably a rigid container (for example, a container made of stainless steel). The outer container 2 may be a new container or a reused container prepared by disassembling a beverage container collected from a user.

In a second step ST2, a fitting 3 is prepared. The second step ST2 is a second preparing step. The fitting 3 prepared in the second preparing step may be a new fitting or a reused fitting prepared by disassembling a beverage container collected from a user.

As shown in FIG. 5, the fitting 3 prepared in the second preparing step includes (1) an attachment portion 32 attachable to the first mouth portion 27 of the outer container 2, (2) a second mouth portion 34 connectable to a beverage filling nozzle or a dispense head, (3) an annular portion 36 extending outward from the second mouth portion 34 and connecting the second mouth portion 34 and the attachment portion 32, and (4) a beverage extraction pipe 45.

The fitting 3 prepared in the second preparing step may have a first valve seat portion 341 and a first valve member 37. Also, the fitting 3 prepared in the second preparing step may have a structure M3 including a first spring 38 that biases the first valve member 37 upward, a first spring receiver 39 that supports the first spring 38, and an outer cylindrical portion 40 arranged outside the beverage extraction pipe 45 and protecting the first spring 38. Further, the fitting 3 prepared in the second preparing step may include a second valve member 41 arranged inside the beverage extraction pipe 45, a second spring 42 that biases the second valve member 41 upward, and a second spring receiver 454 that supports the second spring 42. Also, the fitting 3 prepared in the second preparing step may have a removal-preventing member 46 (see FIG. 15).

In a third step ST3, a replaceable component 5 is prepared. The third step ST3 is a third preparing step. The replaceable component 5 prepared in the third preparing step is a new replaceable component.

As shown in FIG. 14, the replaceable component 5 has (1) a sealing member 52, (2) a tubular body 55 holding the sealing member 52, and (3) a bag 58 for containing a beverage attached to the tubular body 55.

The first step ST1 (the first preparing step), the second step ST2 (the second preparing step), and the third step ST3 (the third preparing step) may be executed in any order.

In a fourth step ST4, the replaceable component 5 is attached to the beverage extraction pipe 45. The fourth step ST4 is a first attaching step. As shown in FIG. 3 etc., in the first attaching step, the sealing member 52 is attached to an upper portion 452 of the beverage extraction pipe 45 by sliding the sealing member 52 relative to the beverage extraction pipe 45. The first attaching step also includes attaching the sealing member 52 to the upper portion 452 of the beverage extraction pipe 45 using a frictional force acting between the sealing member 52 and an outer surface 45*u* of the beverage extraction pipe 45. Since the replaceable component 5 and the beverage extraction pipe 45 are not glued or welded to each other, it is easy to remove the replaceable component 5 from the beverage extraction pipe 45 after the beverage container is collected.

It is preferable that the first attaching step (the fourth step ST4) includes inserting the whole of a lower portion 455 of the beverage extraction pipe 45 and a part of the upper portion 452 of the beverage extraction pipe into the bag 58.

Each sub-step of the first attaching step will be described. As shown in FIG. 21, in a sub-step ST4-1, the lower end 45*g* of the beverage extraction pipe 45 is inserted inside the sealing member 52 of the replaceable component 5.

In a sub-step ST4-2, the sealing member 52 and the tubular body 55 are slid along a longitudinal direction of the beverage extraction pipe 45. In this specification, "slide" means relative sliding of the sealing member 52 with respect to the beverage extraction pipe 45. Therefore, "slide" includes both linear movement of the sealing member 52 relative to the beverage extraction pipe 45 and linear movement of the beverage extraction pipe 45 relative to the sealing member 52.

In an example shown in FIG. 21, the lower portion 455 of the beverage extraction pipe 45 includes a small-diameter pipe portion 45*a*, and the upper portion 452 of the beverage extraction pipe 45 includes a large-diameter pipe portion 45*c*. In this case, when the sealing member 52 is slid along the small-diameter pipe portion 45*a*, there is no frictional resistance or the frictional resistance is reduced. Also, when the sealing member 52 is slid along the large-diameter pipe portion 45*c*, a moderate frictional resistance is applied to the slide of the sealing member 52.

As shown in FIG. 22, in a sub-step ST4-3, the sealing member 52 is brought into annular contact with the outer surface 45*u* of the beverage extraction pipe 45 at an installation position P. In this way, the sealing member 52 is arranged at the installation position P defined by the upper portion 452 of the beverage extraction pipe 45. In an example shown in FIG. 22, the sealing member 52 can be slid with respect to the outer surface 45*u* of the beverage extraction pipe 45 while maintaining a state in which the sealing member 52 is held by the outer surface 45*u* of the beverage extraction pipe 45. In this case, degree of freedom of the installation position P of the sealing member 52 with respect to the beverage extraction pipe 45 is large. For example, in FIG. 22, the sealing member 52 can be attached to the beverage extraction pipe 45 at any position between a position P1 and a position P2. When a large degree of freedom is given to the installation position, the sealing member 52 can be quickly and easily attached to the beverage extraction pipe 45.

When the fitting 3 has the structure M3 including the first spring 38, the first spring receiver 39, and the outer cylindrical portion 40, in the first attaching step, the sealing member 52 is attached to the upper portion 452 of the beverage extraction pipe 45 at a position below the lower end of the structure M3.

In the first attaching step, the sealing member 52 may be attached to the upper portion 452 of the beverage extraction pipe 45 at a position below a spacer member 63. More specifically, the beverage extraction pipe 45 of the fitting 3 may be inserted into a through hole portion 63*h* of the spacer member 63, and the sealing member 52 may then be attached to the upper portion 452 of the beverage extraction pipe 45 at the position below the spacer member 63. Alternatively, in the second preparing step (the second step ST2), the fitting 3 with the spacer member 63 may be prepared, and in the first attaching step (the fourth step ST4), the sealing member 52 may be attached to the upper portion 452 of the beverage extraction pipe 45 at the position below the spacer member 63.

As shown in FIG. 23, the replaceable component 5 and the beverage extraction pipe 45 are inserted into the outer container 2 in a fifth step ST5. The fifth step ST5 is an inserting step. More specifically, the inserting step includes inserting the whole of the beverage extraction pipe 45, the sealing member 52, the tubular body 55 supported by the beverage extraction pipe 45 via the sealing member 52, and the bag 58 attached to the tubular body 55, into the outer container 2 through the first mouth portion 27.

The beverage extraction pipe 45 is an elongated member and its outer diameter is relatively small. Therefore, it is possible to reduce an outer diameter of the replaceable component 5 attached to the beverage extraction pipe 45. More specifically, the outer diameter of the replaceable component 5 can be reduced by folding the bag 58 constituting a part of the replaceable component 5 around the beverage extraction pipe 45. Further, in an example shown in FIG. 23, the sealing member 52 is attached to the beverage extraction pipe 45 at the position below the structure M3 or the spacer member 63. In this case, the bag 58 can be arranged compactly around the beverage extraction pipe 45 by utilizing the vertically downward region of the structure M3 or the vertically downward region of the spacer member 63.

In addition, in the example shown in FIG. 23, the size of the first mouth portion 27 is set to be larger than the size of the second mouth portion 34 due to the presence of the annular portion 36. Therefore, because the bag 58 of the replaceable component 5 is arranged compactly around the beverage extraction pipe 45 and the size of the first mouth portion 27 is large, the whole of the replaceable component 5 can be smoothly inserted into the outer container 2 through the first mouth portion 27.

In a sixth step ST6, the attachment portion 32 of the fitting 3 is attached to the first mouth portion 27 of the outer container 2. The sixth step ST6 is a second attaching step. More specifically, in the second attaching step, the attachment portion 32 of the fitting 3 is threadably engaged with the first mouth portion 27 of the outer container 2.

(Beverage Filling Method)

Next, a process of filling the beverage container 1 with a beverage (in other words, the beverage filling method of filling the beverage container 1 with a beverage) will be described. The process of filling the beverage container 1 with a beverage constitutes a part of the method of handling the beverage container 1. In other words, the method of handling the beverage container 1 includes the process of filling the beverage container 1 with a beverage.

After executing the sixth step ST6, the beverage container 1 is filled with a beverage in a seventh step ST7. The seventh step ST7 is a beverage filling step. In the beverage filling step, the beverage is filled into the bag 58 which has been arranged inside the outer container 2. FIG. 24 shows the beverage filling step in progress.

When filling the bag 58 with the beverage, firstly, the beverage filling nozzle 7 is inserted into the second mouth portion 34 of the fitting 3 in a sub-step ST7-1. In an example shown in FIG. 24, by inserting the beverage filling nozzle 7 into the second mouth portion 34 of the fitting 3, the gas valve V1 and the beverage valve V2 are opened.

Secondly, in a sub-step ST7-2, the beverage is supplied from the beverage filling nozzle 7 into the bag 58 as indicated by an arrow E1 in FIG. 24, and gas (more specifically, air) existing in a space SP3 between the outer container 2 and the bag 58 is discharged to the outside of the outer container 2 as indicated by an arrow E2 in FIG. 24. Thus, the bag 58 is filled with the beverage. In the example shown in FIG. 24, the beverage is supplied into the bag 58 via the beverage valve V2, and the gas is discharged out of the beverage container 1 via the gas valve V1.

In the example shown in FIG. 24, the spacer member 63 is arranged between the annular portion 36 and the tubular body 55. The spacer member 63 prevents over deformation (excessive deformation) of the bag 58 toward the annular portion 36 when the bag 58 is inflated by being filled with the beverage. In this way, damage to the bag 58 is prevented.

In the example shown in FIG. 24, the spacer member 63 prevents the bag 58 from coming into contact with the outer cylindrical portion 40 (for example, the through hole portion 40*h* of the outer cylindrical portion 40) when the bag 58 is inflated. In the example shown in FIG. 24, the spacer member 63 prevents the bag 58 from coming into contact with the removal-preventing member 46 when the bag 58 is inflated. In this way, damage to the bag 58 is prevented.

(Method of Taking Out a Beverage)

Next, a process of taking out a beverage from the beverage container 1 (in other words, a method of taking out a beverage from the beverage container 1) will be described. The process of taking out the beverage from the beverage container 1 constitutes a part of the method of handling the beverage container 1. In other words, the method of handling the beverage container 1 includes the process of taking out the beverage from the beverage container 1.

After executing the seventh step ST7, the beverage is taken out of the beverage container 1 in an eighth step ST8. The eighth step ST8 is a beverage extraction step. In the beverage extraction step, the beverage is taken out of the bag 58 which has been arranged inside the outer container 2. FIG. 25 shows the beverage extraction step in progress. The extraction of the beverage from the bag 58 is performed via the dispense head 8, for example.

In the beverage extraction step, firstly, in a sub-step ST8-1, the dispense head 8 is attached to the second mouth portion 34 of the fitting 3. The mounting is performed by, for example, engaging an engaging portion 81 formed in the main body 80 of the dispense head 8 with an engaging portion 345 of the fitting 3.

In the beverage extraction step, secondly, in a sub-step ST8-2, a plunger member 85 of the dispense head 8 is moved downward with respect to the main body 80 of the dispense head 8. By moving the plunger member 85 downward, the gas valve V1 and the beverage valve V2 are opened. In an example shown in FIG. 25, since the first valve member 37 and the second valve member 41 are pushed by the plunger member 85, the gas valve V1 and the beverage valve V2 are opened.

In the beverage extraction step, thirdly, in a sub-step ST8-3, gas (for example, air) is supplied to the space SP3 between the outer container 2 and the bag 58. The gas is supplied via the dispense head 8. The sub-step ST8-3 is a gas supplying step.

More specifically, in the sub-step ST8-3, the gas supplied from a gas supply source (for example, an air pump) is introduced into a gas inlet hole 80*h* (see an arrow E3 in FIG. 25). The gas introduced into the gas inlet hole 80*h* is supplied to the space SP3 between the outer container 2 and the bag 58 via a gas flow channel F2 and the gas valve V1 (see an arrow E4 in FIG. 25). The gas supplied to the space SP3 presses the bag 58 so that the bag 58 contracts.

In the beverage extraction step, fourthly, in a sub-step ST8-4, the beverage is taken out of the bag 58. The beverage is taken out via the beverage valve V2 and the dispense head 8.

The sub-step ST8-4 will be described in more detail. By executing the above-mentioned sub-step ST8-3 (the gas supplying step), the bag 58 is being bushed downward or inward. Therefore, the beverage in the bag 58 goes to the beverage valve V2 through the inner space of the beverage extraction pipe 45. Since the beverage valve V2 is opened in the above-mentioned sub-step ST8-2 (more specifically, the beverage valve opening step), the beverage in the inner space of the beverage extraction pipe 45 is taken out to the outside of the dispense head 8 via the beverage valve V2 and a beverage flow channel F3 of the plunger member 85 (see an arrow E5 in FIG. 25).

In the method of taking out the beverage according to some embodiments, the beverage is taken out of the bag 58 by supplying the gas to the space SP3 between the outer container 2 and the bag 58. Therefore, the beverage in bag 58 does not come in contact with the supply gas (for example, air) supplied via the dispense head 8. Therefore, the taste, texture, and the like of the beverage do not deteriorate due to the contact of the beverage with the supplied gas. Moreover, when the beverage is a sparkling beverage such as beer, the feel of the foam does not deteriorate.

Further, in the method of taking out the beverage according to some embodiments, it is possible to use air as the gas to be supplied to the space SP3 between the outer container 2 and the bag 58. Therefore, it is not necessary to prepare a carbon dioxide gas cylinder, unlike the conventional method of taking out the beverage. Note that using air as the gas to be supplied to the space SP3 is an optional configuration. In other words, in some embodiments, as the gas to be supplied to the space SP3 between the outer container 2 and the bag 58, the use of gas other than air (for example, carbon dioxide gas) is not excluded.

When the outer container 2 is made of stainless steel, durability and corrosion resistance of the outer container 2 are extremely high, and light-shielding property is excellent. Therefore, the outer container 2 with the bag 58 arranged therein may be stored outdoors.

(Method of Disassembling the Beverage Container 1)

Next, a process of disassembling the beverage container 1 (in other words, a method of disassembling the beverage container 1) will be described. The process of disassembling the beverage container 1 constitutes a part of the method of handling the beverage container 1. In other words, the method of handling the beverage container 1 includes the process of disassembling the beverage container 1.

After executing the eighth step ST8, the beverage container 1 is disassembled in a ninth step ST9. The ninth step ST9 is a disassembling step. Needless to say, the dispense head 8 is removed from the fitting 3 before the disassembling step is performed.

The disassembling step (the ninth step ST9) includes taking out the beverage extraction pipe 45 and the replaceable component 5 from the outer container 2 and removing the replaceable component 5 from the fitting 3.

When the beverage container 1 is provided with the removal-preventing member 46, taking out the beverage extraction pipe 45 and the replaceable component 5 from the outer container 2 is performed with the engaging member 47 of the removal-preventing member 46 retracted from the engaging portion 28 of the outer container 2 (see FIG. 16).

Removing the replaceable component 5 from the fitting 3 includes sliding the sealing member 52 and the tubular body 55 of the replaceable component 5 along the beverage extraction pipe 45 in a direction toward the lower end 45*g* of the beverage extraction pipe 45. In the disassembling step, the replaceable component 5 can be removed from the beverage extraction pipe 45 simply by sliding the sealing member 52 and the tubular body 55 along the beverage extraction pipe 45. Therefore, it is possible to quickly and easily remove the replaceable component 5 from the beverage extraction pipe 45.

The fitting 3 from which the replaceable component 5 has been removed and the outer container 2 are preferably reused in the next beverage filling. On the other hand, once used replaceable component 5 is preferably replaced with another replaceable component (more specifically, a new replaceable component). Note that, since the structure of the replaceable component 5 according to some embodiments is simple, manufacturing cost of the replaceable component 5 is low.

In some embodiments, the bag 58 is filled with the beverage and the beverage does not come in direct contact with the reusable outer container 2. Therefore, safety of the beverage is reliably ensured. In addition, since the beverage does not come in direct contact with the reusable outer container 2, adhesion of organic substances (dirt) or odors to the interior of the outer container 2 is suppressed. From the foregoing, it becomes easy to manage the outer container when the outer container 2 is collected and reused. Moreover, it is possible to simplify a process of cleaning the outer container 2.

The present invention is not limited to each of the above embodiments or each of the above-mentioned modified examples, and it is clear that each embodiment or each modified example can be appropriately modified or can be changed within the scope of the technical idea of the present invention. In addition, the various techniques used in each embodiment or each modified example can be applied to other embodiments or other modified examples as long as there is no technical contradiction. Further, any optional configuration in each embodiment or each modified example can be omitted as appropriate.

DESCRIPTION OF THE REFERENCE NUMERALS 1,1A,1B beverage container, 2 outer container, 3 fitting, 5 replaceable component, 7 beverage filling nozzle, 8 dispense head, 22 container main body, 23 bottom portion, 24 body portion, 25 upper plate portion, 26 welded portion, 27 first mouth portion, 27*e* upper surface, 27*g* lower end, 27*n* inner surface, 27*s* first threaded portion, 27*t* inclined surface, 28 engaging portion, 32 attachment portion, 32*s* second threaded portion, 34 second mouth portion, 36 annular portion, 36*g* lower surface, 36*n* inner portion, 36*u* outer portion, 36*v* groove, 36*w* welded portion, 37 first valve member, 38 first spring, 39 first spring receiver, 40 outer cylindrical portion, 40*g* lower end portion, 40*h* through hole portion, 41 second valve member, 42 second spring, 44 second biasing member, 45 beverage extraction pipe, 45*a* small-diameter pipe portion, 45*b* shoulder portion, 45*c* large-diameter pipe portion, 45*e* upper end, 45*g* lower end, 45*n* inner surface, 45*u* outer surface, 45*w* top wall, 46 removal-preventing member, 47 engaging member, 47*c* second cam surface, 48 first movable member, 49 second movable member, 49*a* link arm, 49*c* first cam surface, 52 sealing member, 55 tubular body, 55*e* upper end portion, 55*g* lower end portion, 58 bag, 58*c* mouth portion, 63 spacer member, 63*d* lower surface, 63*e* upper end portion, 63*f* recess portion, 63*g* lower end portion, 63*h* through hole portion, 65 sealing ring, 80 dispense head main body, 80*h* gas inlet hole, 81 engaging portion, 85 plunger member, 341 first valve seat portion, 345 engaging portion, 347 recess portion, 348 shoulder portion, 349 annular outward protruding portion, 371 second valve seat portion, 451 second valve seat portion, 452 upper portion, 454 second spring receiver, 455 lower portion, 522 lower lip portion, 522*n* inner surface, 522*u* first outer peripheral surface, 524 annular protruding portion, 526 upper lip portion, 526*n* inner surface, 526*u* second outer peripheral surface, 551 tubular portion, 553 first flange, 555 second flange, 557 annular groove, 633 outer shell portion, 635 reinforcing rib, AR1 annular region, C1 central axis, C2 central axis, D beverage, F1 beverage flow channel, F2 gas flow channel, F3 beverage flow channel, G1 gap, G2 gap, M1 assemble body, M2 assemble body, M3 structure, OP1 first opening, OP2 second opening, P installation position, Q1 engaging position, Q2 retracted position, SP1 inner space of outer container, SP2 space in bag, SP3 space between outer container and bag, V1 gas valve, V2 beverage valve

The invention claimed is:

1. A beverage container comprising:

an outer container having a first mouth portion;

a fitting having a beverage extraction pipe; and a replaceable component attached to the beverage extraction pipe and arranged in an inner space of the outer container, wherein the fitting comprises:

an attachment portion attached to the first mouth portion of the outer container;

a second mouth portion connectable to a beverage filling nozzle or a dispense head;

an annular portion extending outward from the second mouth portion and connecting the second mouth portion and the attachment portion; and the beverage extraction pipe extending toward a bottom of the outer container, wherein the replaceable component comprises:

a sealing member slidable along a longitudinal direction of the beverage extraction pipe and being in annular contact with an outer surface of the beverage extraction pipe at an installation position;

a tubular body holding the sealing member and being supported by the beverage extraction pipe via the sealing member located at the installation position; and a bag for containing a beverage attached to the tubular body;

wherein the tubular body includes:

a tubular portion holding the sealing member;

a first flange to which the bag is attached; and a second flange arranged above the first flange, and wherein an outer diameter of the second flange is smaller than an outer diameter of the first flange.

2. The beverage container according to claim 1, further comprising:

a spacer member arranged between the annular portion and the tubular body and preventing the bag from being over-deformed toward the annular portion, wherein the tubular body is movable relative to the spacer member.

3. The beverage container according to claim 2, wherein the spacer member has a lower surface arranged to face the bag, and wherein the lower surface of the spacer member is an inclined surface whose height increases as a distance from the beverage extraction pipe increases.

4. The beverage container according to claim 1, wherein the fitting includes:

a first valve seat portion formed in the second mouth portion; and a first valve member contactable to the first valve seat portion, and wherein the sealing member is arranged vertically below the first valve member.

5. The beverage container according to claim 4, wherein the fitting includes a removal-preventing member preventing the fitting from being removed from the outer container, wherein the removal-preventing member has an engaging member engaging with the outer container, and wherein an engagement between the outer container and the engaging member is released by pushing the first valve member downward.

6. The beverage container according to claim 1, wherein the fitting includes:

a first valve seat portion formed in the second mouth portion; and a first valve member contactable to the first valve seat portion;

an outer cylindrical portion arranged outside the beverage extraction pipe;

a first spring arranged between the beverage extraction pipe and the outer cylindrical portion and biasing the first valve member upward; and a first spring receiver supporting the first spring, and wherein the tubular body of the replaceable component is arranged vertically below a structure including the outer cylindrical portion, the first spring, and the first spring receiver.

7. The beverage container according to claim 1, wherein the second mouth portion of the fitting is arranged above the first mouth portion of the outer container.

8. The beverage container according to claim 1, wherein the sealing member has a lower lip portion, wherein the lower lip portion has a first outer peripheral surface to which a first internal pressure inside the bag is applied, and wherein the first outer peripheral surface is exposed to a space inside the bag.

9. The beverage container according to claim 1, wherein the sealing member has an upper lip portion, wherein the upper lip portion has a second outer peripheral surface to which a second internal pressure inside the outer container is applied, and wherein the second outer peripheral surface is exposed to a space inside the outer container.

10. The beverage container according to claim 1, further comprising:

a sealing ring arranged between the first mouth portion and the annular portion, wherein an upper surface of the first mouth portion and a lower surface of the annular portion are in surface-to-surface contact with each other in a state in which the sealing ring is compressed.

* * * * *